US009304416B2

(12) United States Patent
Noguchi et al.

(10) Patent No.: US 9,304,416 B2
(45) Date of Patent: Apr. 5, 2016

(54) ELECTROPHOTOGRAPHIC PHOTOSENSITIVE MEMBER, METHOD OF PRODUCING ELECTROPHOTOGRAPHIC PHOTOSENSITIVE MEMBER, PROCESS CARTRIDGE, AND ELECTROPHOTOGRAPHIC APPARATUS

(71) Applicant: CANON KABUSHIKI KAISHA, Tokyo (JP)

(72) Inventors: Kazunori Noguchi, Suntou-gun (JP); Yuka Ishiduka, Suntou-gun (JP); Nobuhiro Nakamura, Numazu (JP); Atsushi Okuda, Yokohama (JP); Hiroyuki Tomono, Numazu (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 14/568,511

(22) Filed: Dec. 12, 2014

(65) Prior Publication Data

US 2015/0185635 A1 Jul. 2, 2015

(30) Foreign Application Priority Data

Dec. 26, 2013 (JP) ..... 2013-270560
Nov. 27, 2014 (JP) ..... 2014-240036

(51) Int. Cl.
*G03G 5/14* (2006.01)

(52) U.S. Cl.
CPC . *G03G 5/14* (2013.01); *G03G 5/142* (2013.01)

(58) Field of Classification Search
None
See application file for complete search history.

(56) References Cited

U.S. PATENT DOCUMENTS 5,747,206 A * 5/1998 Agata ..... G03G 5/142 430/60

FOREIGN PATENT DOCUMENTS

JP 2007-148294 A 6/2007
JP 2007-179031 A 7/2007
JP 2010-122440 A 6/2010

OTHER PUBLICATIONS

R. Callahan, et al., "Synthesis of Phencyclone Analogues. Applications for NMR Studies of Hindered Rotations and Magnetic Anisotropy in Crowded Diels-Alder Adducts", Chem. Educator, 2001, vol. 6, pp. 227-234.
U.S. Appl. No. 14/568,714, filed Dec. 12, 2014. Inventor: Sekiya, et al.
U.S. Appl. No. 14/568,052, filed Dec. 11, 2014. Inventor: Sekiya, et al.
U.S. Appl. No. 14/571,689, filed Dec. 16, 2014. Inventor: Nakamura, et al.
U.S. Appl. No. 14/573,410, filed Dec. 17, 2014. Inventor: Ito, et al.

* cited by examiner

*Primary Examiner* — Peter Vajda
(74) *Attorney, Agent, or Firm* — Fitzpatrick, Cella, Harper and Scinto

(57) ABSTRACT

Provided is an electrophotographic photosensitive member, including: a support; an undercoat layer formed on the support; and a photosensitive layer formed on the undercoat layer, in which the undercoat layer includes a cured product of a composition including (i) an isocyanate compound having a structure represented by the following specific formula (1), (ii) at least one resin selected from a polyvinyl acetal and an acrylic polyol; and (iii) a compound represented by any one of the specific formulae (A1) to (A8).

(1)

10 Claims, 2 Drawing Sheets

ELECTROPHOTOGRAPHIC PHOTOSENSITIVE MEMBER, METHOD OF PRODUCING ELECTROPHOTOGRAPHIC PHOTOSENSITIVE MEMBER, PROCESS CARTRIDGE, AND ELECTROPHOTOGRAPHIC APPARATUS

BACKGROUND OF THE INVENTION

1. Field of the Invention

The present invention relates to an electrophotographic photosensitive member and a method of producing the electrophotographic photosensitive member, and a process cartridge and an electrophotographic apparatus each including the electrophotographic photosensitive member.

2. Description of the Related Art

An electrophotographic photosensitive member generally includes a support and a photosensitive layer formed on the support. In addition, an undercoat layer is often formed between the support and the photosensitive layer for the purpose of suppressing the injection of charge from the support toward the photosensitive layer to suppress the occurrence of an image defect such as a black spot.

In recent years, a charge generation substance having additionally high sensitivity has been used as a charge generation substance for the electrophotographic photosensitive member.

However, as the sensitivity of the charge generation substance rises, the amount of charge to be generated increases. Accordingly, a problem has arisen in that the charge is liable to remain in the photosensitive layer and hence a ghost is liable to occur. Specifically, the so-called positive ghost phenomenon, in which the density of only a portion irradiated with light at the time of forward rotation in an output image increases, is liable to occur.

To solve the problem, Japanese Patent Application Laid-Open No. 2010-122440, Japanese Patent Application Laid-Open No. 2007-148294, and Japanese Patent Application Laid-Open No. 2007-179031 each disclose a technology involving incorporating an electron transport substance into the undercoat layer. In addition, Japanese Patent Application Laid-Open No. 2007-148294 describes the following technology. When the electron transport substance is incorporated into the undercoat layer, the undercoat layer is cured so that the electron transport substance may not be eluted in a solvent in an application liquid for the photosensitive layer at the time of the formation of the layer above the undercoat layer (photosensitive layer).

A requirement for the quality of an electrophotographic image does not cease to become more and more sophisticated nowadays, and hence tolerance for the positive ghost has become markedly strict.

In addition, studies made by the inventors of the present invention have found that the technology disclosed in each of the above-mentioned documents is susceptible to improvement in terms of a suppressive effect on the positive ghost.

SUMMARY OF THE INVENTION

The present invention is directed to providing an electrophotographic photosensitive member suppressed in positive ghost and a method of producing the electrophotographic photosensitive member. The present invention is also directed to providing a process cartridge and an electrophotographic apparatus each including the electrophotographic photosensitive member.

According to one aspect of the present invention, there is provided an electrophotographic photosensitive member, including:

a support;

an undercoat layer formed on the support; and a photosensitive layer formed on the undercoat layer, in which the undercoat layer includes a cured product of a composition including (i) an isocyanate compound having a structure represented by the following formula (1), (ii) at least one resin selected from the group consisting of a polyvinyl acetal and an acrylic polyol, and (iii) a compound represented by any one of the following formulae (A1) to (A8).

(1)

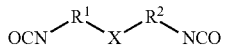

In the formula (1), $R^1$ and $R^2$ each independently represent a single bond or an alkylene group having 1 to 6 carbon atoms, and X represents a bivalent group represented by any one of the following formulae (2) to (7).

(2)

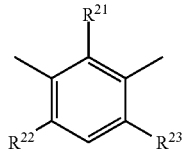

(3)

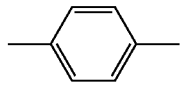

(4)

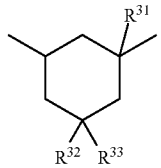

(5)

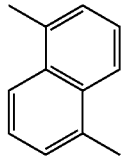

(6)

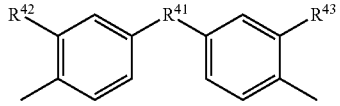

(7)

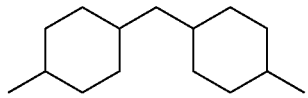

In the formulae (2) to (7), $R^{21}$, $R^{22}$, $R^{23}$, $R^{31}$, $R^{32}$, $R^{33}$, $R^{42}$, and $R^{43}$ each independently represent a hydrogen atom or a methyl group, and $R^{41}$ represents a single bond or a methylene group.

(A1)

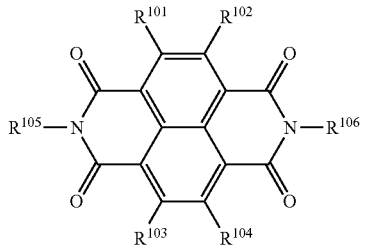

(A2)

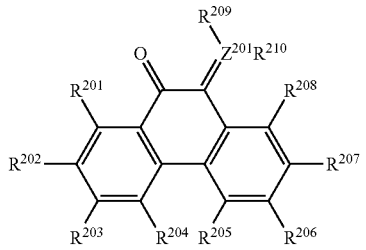

(A3)

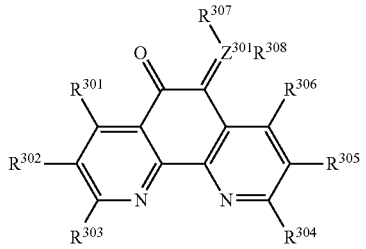

(A4)

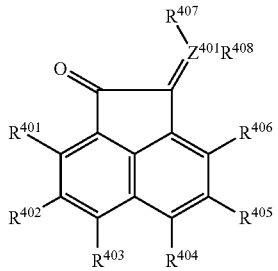

(A5)

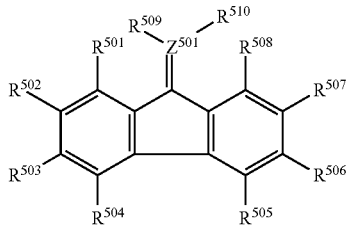

(A6)

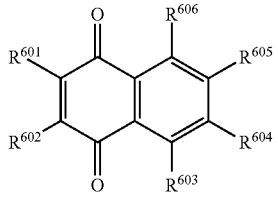

-continued (A7)

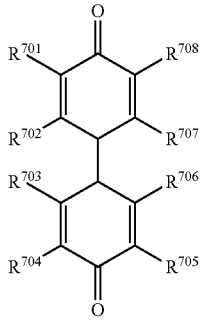

(A8)

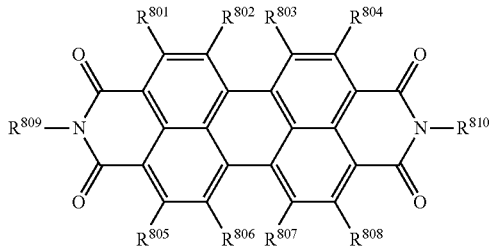

In the formulae (A1) to (A8), $R^{101}$ to $R^{106}$, $R^{201}$ to $R^{210}$, $R^{301}$, to $R^{308}$, $R^{401}$ to $R^{408}$, $R^{501}$ to $R^{510}$, $R^{601}$ to $R^{606}$, $R^{701}$ to $R^{708}$, and $R^{801}$ to $R^{810}$ each independently represent a monovalent group represented by the following formula (A), a hydrogen atom, a cyano group, a nitro group, a halogen atom, an alkoxycarbonyl group, an unsubstituted or substituted alkyl group, a group derived by substituting one of carbon atoms in a main chain of the unsubstituted or substituted alkyl group with an oxygen atom, a group derived by substituting one of the carbon atoms in the main chain of the unsubstituted or substituted alkyl group with a sulfur atom, a group derived by substituting one of the carbon atoms in the main chain of the unsubstituted or substituted alkyl group with $NR^{10}$, or an unsubstituted or substituted aryl group, and $R^{10}$ represents a hydrogen atom or an alkyl group, provided that at least one of $R^{101}$ to $R^{106}$, at least one of $R^{201}$ to $R^{210}$, at least one of $R^{301}$ to $R^{308}$, at least one of $R^{401}$ to $R^{408}$, at least one of $R^{501}$ to $R^{510}$, at least one of $R^{601}$ to $R^{606}$, at least one of $R^{701}$ to $R^{708}$, and at least one of $R^{801}$ to $R^{810}$ each represent the monovalent group represented by the formula (A).

A substituent of the substituted alkyl group is an alkyl group, an aryl group, or a halogen atom, and a substituent of the substituted aryl group includes a halogen atom, a nitro group, a cyano group, an alkyl group, or a halogenated alkyl group.

$Z^{201}$, $Z^{301}$, and $Z^{501}$ each independently represent a carbon atom, a nitrogen atom, or an oxygen atom. $R^{209}$ and $R^{210}$ are absent when $Z^{201}$ represents the oxygen atom, and $R^{210}$ is absent when $Z^{201}$ represents the nitrogen atom. $R^{307}$ and $R^{308}$ are absent when $Z^{301}$ represents the oxygen atom, and $R^{308}$ is absent when $Z^{301}$ represents the nitrogen atom. $R^{407}$ and $R^{408}$ are absent when $Z^{401}$ represents the oxygen atom, and $R^{408}$ is absent when $Z^{401}$ represents the nitrogen atom. $R^{509}$ and $R^{510}$ are absent when $Z^{501}$ represents the oxygen atom, and $R^{510}$ is absent when $Z^{501}$ represents the nitrogen atom.

$$-(\alpha)_l-(\beta)_m-\gamma \quad (A)$$

In the formula (A), at least one of α, β, and γ represents a group having a polymerizable functional group, and the polymerizable functional group includes at least one kind of group selected from the group consisting of a hydroxy group, a thiol group, an amino group, and a carboxyl group. l and m each independently represent 0 or 1, and a sum of l and m is 0 or more and 2 or less.

α represents an unsubstituted or substituted alkylene group having 1 to 6 main-chain carbon atoms, a group derived by substituting one of the carbon atoms in a main chain of the unsubstituted or substituted alkylene group having 1 to 6 main-chain carbon atoms with an oxygen atom, a group derived by substituting one of the carbon atoms in the main chain of the unsubstituted or substituted alkylene group having 1 to 6 main-chain carbon atoms with a sulfur atom, or a group derived by substituting one of the carbon atoms in the main chain of the unsubstituted or substituted alkylene group having 1 to 6 main-chain carbon atoms with $NR^{19}$, and each of the groups represented by α may have the polymerizable functional group. $R^{19}$ represents a hydrogen atom or an alkyl group.

A substituent of the substituted alkylene group is an alkyl group having 1 to 6 carbon atoms, a benzyl group, an alkoxycarbonyl group, or a phenyl group.

β represents a phenylene group, a phenylene group substituted with an alkyl group having 1 to 6 carbon atoms, a phenylene group substituted with a nitro group, a phenylene group substituted with a halogen atom, or a phenylene group substituted with an alkoxy group, and each of the groups represented by β may have the polymerizable functional group.

γ represents a hydrogen atom, an alkyl group having 1 to 6 main-chain carbon atoms, or an alkyl group having 1 to 6 main-chain carbon atoms and substituted with an alkyl group having 1 to 6 carbon atoms, and each of the groups represented by γ may have the polymerizable functional group.

Further, according to another aspect of the present invention, there is provided a process cartridge, including:

the electrophotographic photosensitive member; and at least one unit selected from the group consisting of a charging unit, a developing unit, and a cleaning unit, the process cartridge integrally supporting the electrophotographic photosensitive member and the at least one unit, the process cartridge being removably mounted onto a main body of an electrophotographic apparatus.

Further, according to still another aspect of the present invention, there is provided an electrophotographic apparatus, including:

the electrophotographic photosensitive member;

a charging unit;

an exposing unit;

a developing unit; and a transferring unit.

Further, according to yet another aspect of the present invention, there is provided a method of producing an electrophotographic photosensitive member including:

a support;

an undercoat layer formed on the support; and a photosensitive layer formed on the undercoat layer, the method including the steps of:

preparing an application liquid for the undercoat layer, the application liquid including a composition including (i) an isocyanate compound having a structure represented by the formula (1), (ii) at least one resin selected from the group consisting of a polyvinyl acetal and an acrylic polyol, and (iii) a compound represented by any one of the formulae (A1) to (A8); and forming a coating film of the application liquid for the undercoat layer, followed by drying and curing of the coating film to form the undercoat layer.

As described above, according to the aspects of the present invention, it is possible to provide the electrophotographic photosensitive member suppressed in positive ghost and the method of producing the electrophotographic photosensitive member. In addition, according to other embodiments of the present invention, it is possible to provide the process cartridge and the electrophotographic apparatus each including the electrophotographic photosensitive member.

Further features of the present invention will become apparent from the following description of exemplary embodiments with reference to the attached drawings.

DESCRIPTION OF THE EMBODIMENTS

Figure 1A:
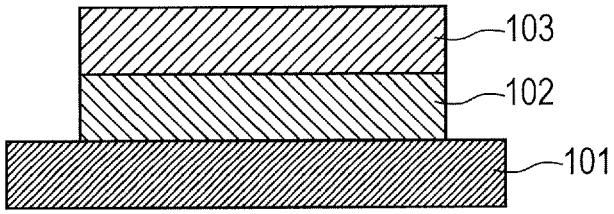
FIGS. 1A and 1B are each a view illustrating an example of the layer construction of an electrophotographic photosensitive member.

Preferred embodiments of the present invention will now be described in detail in accordance with the accompanying drawings.

The inventors of the present invention have assumed the reason why an electrophotographic photosensitive member including an undercoat layer of the present invention has an excellent effect by which the suppression of a positive ghost is achieved at a high level as described below.

In the present invention, an isocyanate group of an isocyanate compound having a structure represented by the formula (1), a —OH group of at least one resin selected from a polyvinyl acetal and an acrylic polyol, and a polymerizable functional group of a compound represented by any one of the formulae (A1) to (A8) are bonded to one another. Thus, a polymerized product (cured product) is formed. When the undercoat layer contains the polymerized product, an undercoat layer that can transport an electron and hardly dissolves in a solvent can be formed. Hereinafter, the compound represented by any one of the formulae (A1) to (A8) is sometimes referred to as "electron transport substance."

However, in the case of the undercoat layer containing the cured product obtained by polymerizing a composition containing a plurality of constituent materials (the isocyanate compound, the electron transport substance, and the resin) as described above, constituent materials having the same structure agglomerate and hence an uneven undercoat layer is liable to be formed. Accordingly, an electron is liable to remain in the undercoat layer or at an interface between the undercoat layer and a photosensitive layer, and hence a ghost is liable to occur. In view of the foregoing, the constituent materials need to be selected so that the constituent materials may hardly agglomerate and may not be eluted upon application of the photosensitive layer.

The isocyanate compound of the present invention has the following characteristic: the compound has a phenylene group, a cyclohexylene group, or a naphthalene group between isocyanate groups. Because of the characteristic, the compound further has the following characteristic: the isocyanate groups are not adjacent to each other, and hence the compound is moderately bulky and has a large volume. Probably because of the foregoing, a suppressing action on film agglomeration (uneven distribution) upon polymerization of an isocyanate group of the isocyanate compound with the resin is exhibited. Further, the electron transport substance is bonded to the isocyanate compound bonded to the molecular chain of the resin suppressed in uneven distribution, and hence the electron transport substance is also uniformly present in the undercoat layer without being unevenly distributed. Probably because of the foregoing, a polymerized product in which structures derived from the isocyanate compound, the electron transport substance, and the resin are uniformly present is obtained, the remaining of the electron is significantly reduced, and an additionally high level of ghost-suppressing effect is obtained.

Examples of an isocyanate compound except the isocyanate compound of the present invention include an isocyanate compound of a chain structure such as hexamethylene diisocyanate, an isocyanate compound having a long side chain, and such an isocyanate compound that —NCO groups are positioned so as to be adjacent to each other. In addition, the examples include a compound obtained by directly bonding a moiety having an electron transport ability to an isocyanate compound. In the case of a polymerized product obtained by polymerizing any such isocyanate compound, the agglomeration of the structure derived from the compound is liable to occur in the polymerized product, and hence a high level of positive ghost-suppressing effect is not sufficiently obtained in some cases.

In order that a sufficient ghost-suppressing effect may be obtained, it may be desired that steric hindrance upon curing be suppressed by causing the electron transport substance of the present invention to uniformly exist in a film through the selection of the structure of the electron transport substance. The inventors have considered that a high level of ghost-suppressing effect is obtained as a result of the foregoing. The inventors have considered that in the case of an anthraquinone derivative in which a hydroxy group directly coordinates to anthraquinone such as alizarin, an anthraquinone structure causes steric hindrance upon curing, and hence uniform curing and sufficient curing are not obtained, and a ghost-suppressing effect is not obtained in some cases.

As described above, the electrophotographic photosensitive member of the present invention is an electrophotographic photosensitive member including a support, an undercoat layer formed on the support, and a photosensitive layer formed on the undercoat layer.

Figure 1B:
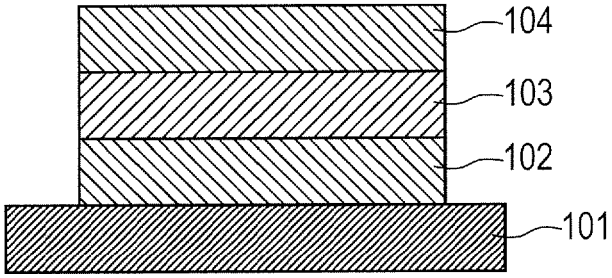

FIGS. 1A and 1B each illustrate an example of the layer construction of the electrophotographic photosensitive member of the present invention. In FIGS. 1A and 1B, reference numeral 101 represents the support, reference numeral 102 represents the undercoat layer, reference numeral 103 represents the photosensitive layer, and reference numeral 104 represents a protective layer.

The photosensitive layer is preferably a laminated photosensitive layer obtained by laminating a charge generation layer containing a charge generation substance and a charge transport layer containing a charge transport substance in the stated order from a side closer to the undercoat layer. In addition, the charge transport substance to be incorporated into the charge transport layer is preferably a hole transport substance.

The support is preferably a support having conductivity (conductive support). Examples thereof include supports made of metals (or made of alloys) such as aluminum, an aluminum alloy, stainless steel, copper, nickel, and zinc. In addition, when a support made of aluminum or a support made of an aluminum alloy is used, an ED tube, an EI tube, or the like can be used.

A product obtained by forming a thin film of a conductive material such as aluminum, an aluminum alloy, or an indium oxide-tin oxide alloy on a support made of a metal or a support made of a resin can also be used as the support.

In addition, the surface of the support may be subjected to cutting treatment, roughening treatment, alumite treatment, composite electrolytic polishing treatment, wet honing treatment, dry honing treatment, or the like for the purpose of, for example, the suppression of interference fringes due to the scattering of laser light. The composite electrolytic polishing involves: electrolysis with an electrode having an electrolytic action and an electrolytic solution; and polishing with a grindstone having a polishing action.

A conductive layer may be formed between the support and the undercoat layer for the purposes of, for example, suppressing the interference fringes due to the scattering of the laser light and concealing (covering) a flaw in the support.

The conductive layer can be formed by: applying an application liquid for the conductive layer, which is obtained by subjecting carbon black, conductive particles such as a metal particle and a metal oxide particle, a binder resin, and a solvent to dispersion treatment, to form a coating film; and drying the resultant coating film.

A method for the dispersion treatment is, for example, a method involving using a homogenizer, an ultrasonic dispersing machine, a ball mill, a sand mill, a roll mill, a vibration mill, an attritor, or a liquid collision-type high-speed dispersing machine.

Examples of the binder resin to be used for the conductive layer include polyester, polycarbonate, polyvinyl butyral, an acrylic resin, a silicone resin, an epoxy resin, a melamine resin, a urethane resin, a phenol resin, and an alkyd resin. In addition, only one kind of those binder resins may be used, or two or more kinds thereof may be used in combination as a mixture or a copolymer.

Examples of the solvent of the application liquid for the conductive layer include an ether-based solvent, an alcohol-based solvent, a ketone-based solvent, and an aromatic hydrocarbon-based solvent. In addition, only one kind of those solvents may be used, or two or more kinds thereof may be used in combination.

The thickness of the conductive layer is preferably 5 μm or more and 40 μm or less, more preferably 10 μm or more and 30 μm or less.

The undercoat layer is formed between the support or the conductive layer and the photosensitive layer (the charge generation layer and the charge transport layer).

The undercoat layer contains a cured product of a composition containing (i) an isocyanate compound having a structure represented by the following formula (1), (ii) at least one resin selected from the group consisting of a polyvinyl acetal and an acrylic polyol, and (iii) a compound represented by any one of the following formulae (A1) to (A8).

(1)

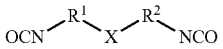

In the formula (1), $R^1$ and $R^2$ each independently represent a single bond or an alkylene group having 1 to 6 carbon atoms, and X represents a bivalent group represented by any one of the following formulae (2) to (7).

(2)

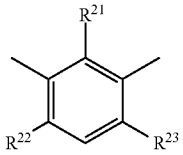

(3)

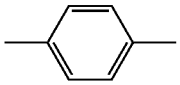

(4)

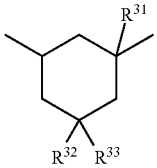

(5)

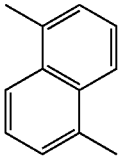

(6)

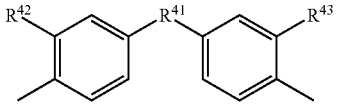

(7)

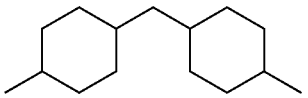

In the formulae (2) to (7), $R^{21}$, $R^{22}$, $R^{23}$, $R^{31}$, $R^{32}$, $R^{33}$, $R^{42}$, and $R^{43}$ each independently represent a hydrogen atom or a methyl group, and $R^{41}$ represents a single bond or a methylene group.

(A1)

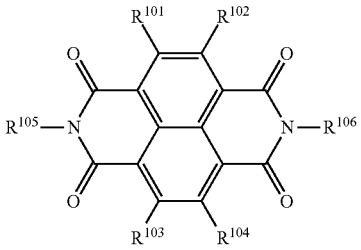

-continued (A2)

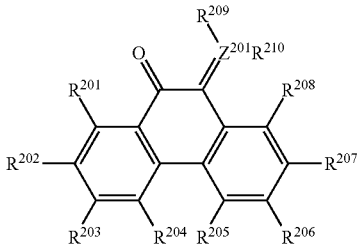

(A3)

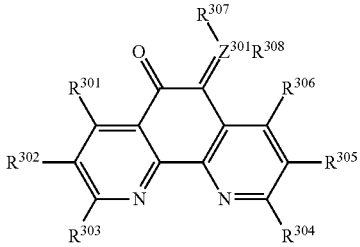

(A4)

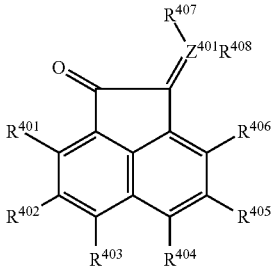

(A5)

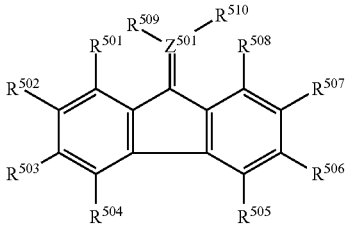

(A6)

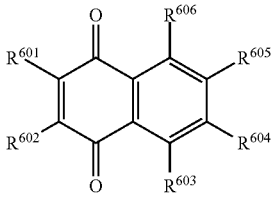

(A7)

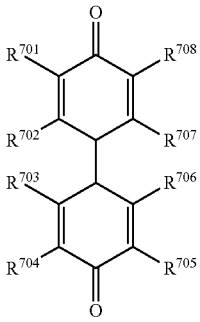

-continued (A8)

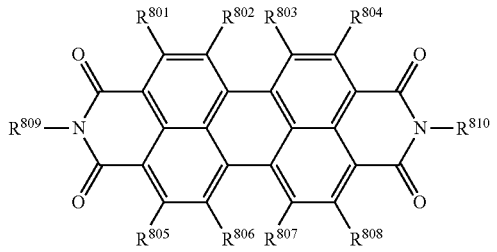

In the formulae (A1) to (A8), $R^{101}$ to $R^{106}$, $R^{201}$ to $R^{210}$, $R^{301}$ to $R^{308}$, $R^{401}$ to $R^{408}$, $R^{501}$ to $R^{510}$, $R^{601}$ to $R^{606}$, $R^{701}$ to $R^{708}$, and $R^{801}$ to $R^{810}$ each independently represent a monovalent group represented by the following formula (A), a hydrogen atom, a cyano group, a nitro group, a halogen atom, an alkoxycarbonyl group, an unsubstituted or substituted alkyl group, a group derived by substituting one of carbon atoms in a main chain of the unsubstituted or substituted alkyl group with an oxygen atom, a group derived by substituting one of the carbon atoms in the main chain of the unsubstituted or substituted alkyl group with a sulfur atom, a group derived by substituting one of the carbon atoms in the main chain of the unsubstituted or substituted alkyl group with $NR^{10}$, or an unsubstituted or substituted aryl group, and $R^{10}$ represents a hydrogen atom or an alkyl group, provided that at least one of $R^{101}$ to $R^{106}$, at least one of $R^{201}$ to $R^{210}$, at least one of $R^{301}$ to $R^{308}$, at least one of $R^{401}$ to $R^{408}$, at least one of $R^{501}$ to $R^{510}$, at least one of $R^{601}$ to $R^{606}$, at least one of $R^{701}$ to $R^{708}$, and at least one of $R^{801}$ to $R^{810}$ each represent the monovalent group represented by the formula (A).

A substituent of the substituted alkyl group is an alkyl group, an aryl group, or a halogen atom, and a substituent of the substituted aryl group is a halogen atom, a nitro group, a cyano group, an alkyl group, or a halogenated alkyl group. $Z^{201}$, $Z^{301}$, $Z^{401}$, and $Z^{501}$ each independently represent a carbon atom, a nitrogen atom, or an oxygen atom. $R^{209}$ and $R^{210}$ are absent when $Z^{201}$ represents the oxygen atom, and $R^{210}$ is absent when $Z^{201}$ represents the nitrogen atom. $R^{307}$ and $R^{308}$ are absent when $Z^{301}$ represents the oxygen atom, and $R^{308}$ is absent when $Z^{301}$ represents the nitrogen atom. $R^{407}$ and $R^{408}$ are absent when $Z^{401}$ represents the oxygen atom, and $R^{408}$ is absent when $Z^{401}$ represents the nitrogen atom. $R^{509}$ and $R^{510}$ are absent when $Z^{501}$ represents the oxygen atom, and $R^{510}$ is absent when $Z^{501}$ represents the nitrogen atom.

(A)

$$-(\alpha)_l-(\beta)_m-\gamma$$

In the formula (A), at least one of α, β, and γ represents a group having a polymerizable functional group, and the polymerizable functional group is at least one kind of group selected from the group consisting of a hydroxy group, a thiol group, an amino group, and a carboxyl group. l and m each independently represent 0 or 1, and a sum of l and m is 0 or more and 2 or less.

α represents an unsubstituted or substituted alkylene group having 1 to 6 main-chain carbon atoms, a group derived by substituting one of the carbon atoms in a main chain of the unsubstituted or substituted alkylene group having 1 to 6 main-chain carbon atoms with an oxygen atom, a group derived by substituting one of the carbon atoms in the main chain of the unsubstituted or substituted alkylene group having 1 to 6 main-chain carbon atoms with a sulfur atom, or a group derived by substituting one of the carbon atoms in the main chain of the unsubstituted or substituted alkylene group having 1 to 6 main-chain carbon atoms with $NR^{19}$, and each of the groups represented by α may have the polymerizable functional group. $R^{19}$ represents a hydrogen atom or an alkyl group.

A substituent of the substituted alkylene group is an alkyl group having 1 to 6 carbon atoms, a benzyl group, an alkoxycarbonyl group, or a phenyl group.

β represents a phenylene group, a phenylene group substituted with an alkyl group having 1 to 6 carbon atoms, a phenylene group substituted with a nitro group, a phenylene group substituted with a halogen atom, or a phenylene group substituted with an alkoxy group, and each of the groups represented by β may have the polymerizable functional group.

γ represents a hydrogen atom, an alkyl group having 1 to 6 main-chain carbon atoms, or an alkyl group having 1 to 6 main-chain carbon atoms and substituted with an alkyl group having 1 to 6 carbon atoms, and each of the groups represented by γ may have the polymerizable functional group.

A method of forming the undercoat layer is as described below. First, a coating film of an application liquid for the undercoat layer containing the isocyanate compound, the at least one resin selected from the group consisting of the polyvinyl acetal and the acrylic polyol, and the compound represented by any one of the formulae (A1) to (A8) is formed. Next, the coating film of the application liquid for the undercoat layer is dried under heat and cured to form the undercoat layer. After the formation of the coating film, those compounds are polymerized (cured) by a chemical reaction. Performing heating at that time accelerates the chemical reaction and hence accelerates the polymerization.

A solvent to be used in the application liquid for the undercoat layer is, for example, an alcohol-based solvent, a sulfoxide-based solvent, a ketone-based solvent, an ether-based solvent, an ester-based solvent, or an aromatic hydrocarbon solvent.

The content of the cured product is preferably 50 mass % or more and 100 mass % or less, more preferably 80 mass % or more and 100 mass % or less with respect to the total mass of the undercoat layer from the viewpoint of the suppression of a ghost.

In addition to the cured product, any other resin, a crosslinking agent except the isocyanate compound, an organic particle, an inorganic particle, a leveling agent, or the like may be incorporated into the undercoat layer for improving the film formability and electrical characteristics of the undercoat layer. It is to be noted that the content of any such material in the undercoat layer is preferably less than 50 mass %, more preferably less than 20 mass % with respect to the total mass of the undercoat layer.

The compound represented by any one of the formulae (A1) to (A8) preferably has a molecular weight of 150 or more and 1,000 or less. When the molecular weight falls within the range, the structure derived from the electron transport substance may be present in the undercoat layer in an additionally uniform manner.

In addition, a ratio between the molecular weight of the compound represented by any one of the formulae (A1) to (A8) and the molecular weight of the isocyanate compound is preferably from 3/20 to 50/20, more preferably from 12/20 to 28/20 from the viewpoint of the uniformity of the structure derived from the electron transport substance.

Next, specific examples of the electron transport substance are shown below. Table 1-1, Table 1-2, Table 1-3, and Table 1-4 show specific examples of the compound represented by the formula (A1). Table 2-1 and Table 2-2 show specific examples of the compound represented by the formula (A2). Table 3-1 and Table 3-2 show specific examples of the compound represented by the formula (A3). Table 4-1 and Table 4-2 show specific examples of the compound represented by the formula (A4). Table 5-1 and Table 5-2 show specific examples of the compound represented by the formula (A5). Table 6 shows specific examples of the compound represented by the formula (A6). Table 7-1 and Table 7-2 show specific examples of the compound represented by the formula (A7). Table 8-1 and Table 8-2 show specific examples of the compound represented by the formula (A8). In the tables, A' is represented by the same structural formula as that of A, and specific examples of a monovalent group thereof are shown in the columns A and A'. When γ in the tables represents "-", γ represents a hydrogen atom, and the hydrogen atom represented by γ is displayed while being incorporated into a structure shown in the column α or β.

TABLE 1-1

| Exemplified | | | | | | | A | | |
|---|---|---|---|---|---|---|---|---|---|
| Compound | $R^{101}$ | $R^{102}$ | $R^{103}$ | $R^{104}$ | $R^{105}$ | $R^{106}$ | α | β | γ |
| A101 | H | H | H | H | 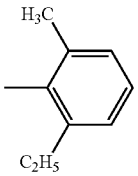 | A | 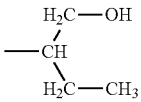 | — | — |
| A102 | H | H | H | H | 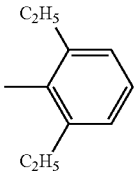 | A | 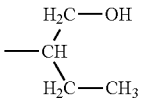 | — | — |
| A103 | H | H | H | H | 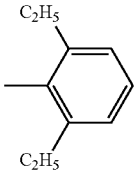 | A | — | 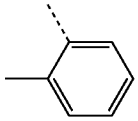 | 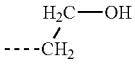 |
| A104 | H | H | H | H | 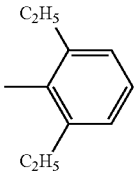 | A | — | 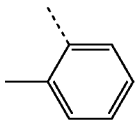 | 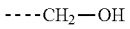 |
| A105 | H | H | H | H | 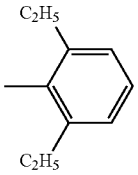 | A | — | 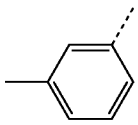 | 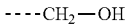 |
| A106 | H | H | H | H | 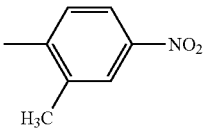 | A | 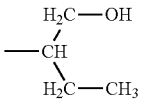 | — | — |
| A107 | H | H | H | H | 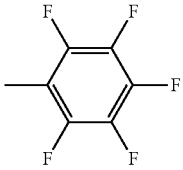 | A | 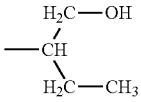 | — | — |

TABLE 1-1-continued
| Exemplified Compound | $R^{101}$ | $R^{102}$ | $R^{103}$ | $R^{104}$ | $R^{105}$ | $R^{106}$ | A α | A β | A γ |
|---|---|---|---|---|---|---|---|---|---|
| A108 | H | H | H | H | 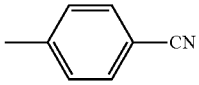 | A | 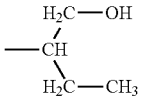 | — | — |
| A109 | H | H | H | H | 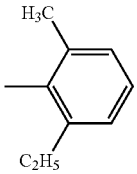 | A | $—C_5H_{10}—OH$ | — | — |
| A110 | H | H | H | H | $—C_6H_{13}$ | A | 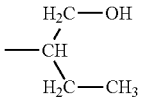 | — | — |
| A111 | H | H | H | H | 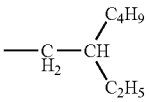 | A | — | 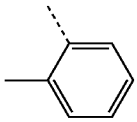 | 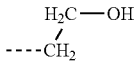 |
| A112 | H | H | H | H | 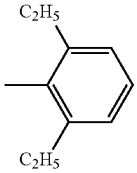 | A | — | 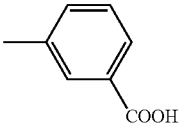 | — |
| A113 | H | H | H | H | 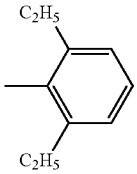 | A | — | 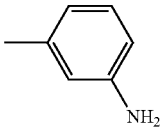 | — |
| A114 | H | H | H | H | 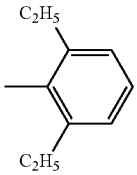 | A | — | 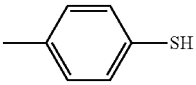 | — |
| A115 | H | H | H | H | 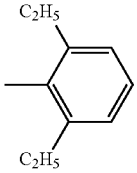 | A | — | 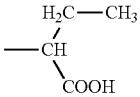 | — |
| A150 | H | H | H | H | 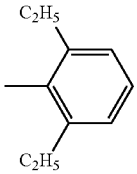 | A | — | 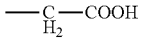 | — |

TABLE 1-2
| | | | | | | | | | |
|---|---|---|---|---|---|---|---|---|---|
| A116 | H | H | H | H | $C_2H_5$ 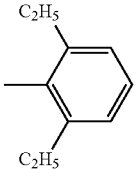 $C_2H_5$ | A | — | 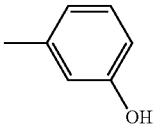 OH | — |
| A117 | H | H | H | H | $C_2H_5$ 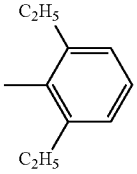 $C_2H_5$ | A | — | 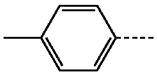 | --C(H$_2$)—COOH |
| A118 | 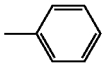 | H | H | 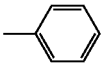 | $C_2H_5$ 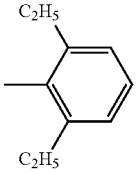 $C_2H_5$ | A | $H_2C$—OH / —CH \ $H_2C$—$CH_3$ | — | — |
| A119 | CN | H | H | CN | $H_3C$ 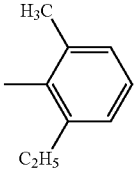 $C_2H_5$ | A | $H_2C$—OH / —CH \ $H_2C$—$CH_3$ | — | — |
| A120 | A | H | H | H | $H_3C$ 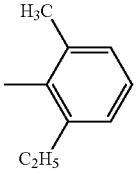 $C_2H_5$ | $H_3C$ 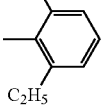 $C_2H_5$ | —COOH | — | — |
| A121 | H | $NO_2$ | H | $NO_2$ | $H_3C$ 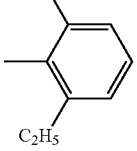 $C_2H_5$ | A | $H_2C$—OH / —CH \ $H_2C$—$CH_3$ | — | — |
| A122 | H | H | H | H | $H_3C$ 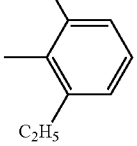 $C_2H_5$ | A | $H_2C$—OH / —CH \ $H_2C$—OH | — | — |
| A123 | H | $NO_2$ | H | $NO_2$ | A | A | $H_2C$—OH / —CH \ $H_2C$—$CH_3$ | — | — |
| A124 | H | H | H | H | A | A | — | 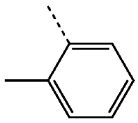 | --$CH_2$—OH |

TABLE 1-2-continued
| | | | | | | | | | |
|---|---|---|---|---|---|---|---|---|---|
| A125 | H | H | H | H | A | A | — | 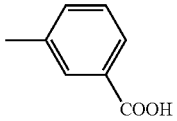 | — |
| A126 | H | H | H | H | A | A | — | 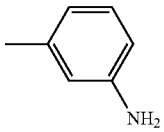 | — |
| A127 | H | H | H | H | A | A | — | 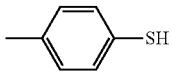 | — |
| A128 | H | H | H | H | A | A | — | 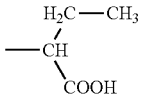 | — |
| A129 | H | H | H | H | A | A | — | 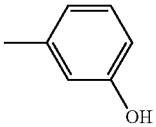 | — |
| A130 | H | H | H | H | 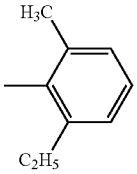 | A | 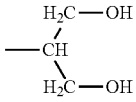 | — | — |
| A131 | H | H | H | H | 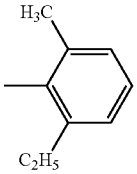 | A | 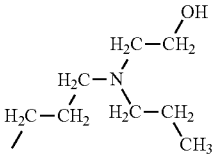 | — | — |
| A132 | H | H | H | H | 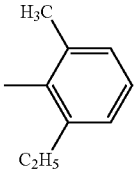 | A | 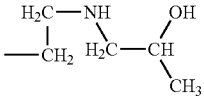 | — | — |
TABLE 1-3
| | | | | | | | | | |
|---|---|---|---|---|---|---|---|---|---|
| A133 | H | H | H | H | 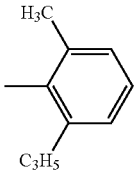 | A | 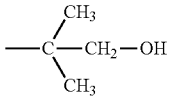 | — | — |

TABLE 1-3-continued
| | | | | | | | | | |
|---|---|---|---|---|---|---|---|---|---|
| A134 | H | H | H | H | A | A | 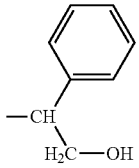 | — | — |
| A135 | H | H | H | H | A | A | 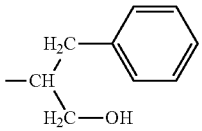 | — | — |
| A136 | H | H | H | H | A | A | 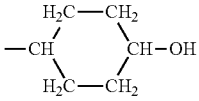 | — | — |
| A137 | H | H | H | H | A | A | — | 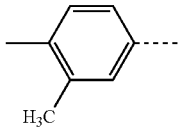 | 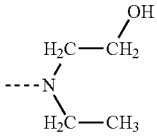 |
| A138 | H | H | H | H | 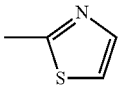 | A | 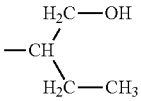 | — | — |
| A139 | H | H | H | H | 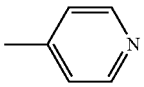 | A | 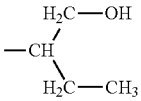 | — | — |
| A140 | H | H | H | H | 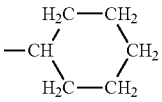 | A | 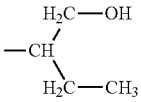 | — | — |
| A141 | H | H | H | H | A | A | 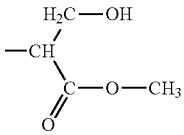 | — | — |
| A142 | CN | H | H | CN | 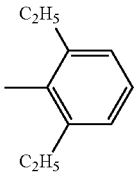 | A | 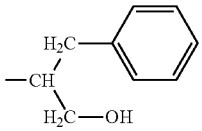 | — | — |
| A143 | H | H | H | H | $—C_2H_4—O—C_2H_5$ | A | 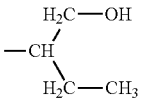 | — | — |
| A144 | H | H | H | H | 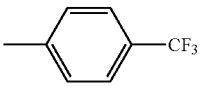 | A | $—C_2H_4—O—C_2H_4—OH$ | — | — |

TABLE 1-3-continued

| | | | | | | | | | |
|---|---|---|---|---|---|---|---|---|---|
| A145 | H | H | H | H | A | A | $H_2C—OH$ / —CH / $H_2C—CH_3$ | — | — |
| A146 | H | H | H | H | —$CH_2CH_2$— | A | $H_2C—OH$ / —CH / $H_2C—CH_3$ | — | — |
| A147 | H | H | H | H | O, NH, O, NH, O | A | —$C_2H_4$—O—$C_2H_4$—OH | — | — |
| A148 | H | H | H | H | —F | A | —$CH_2CH_2$--- | ----OH | — |
| A149 | H | H | H | H | —$OCH_3$ | A | — | COOH, COOH | — |

TABLE 1-4

| Exemplified Compound | $R^{101}$ | $R^{102}$ | $R^{103}$ | $R^{104}$ | $R^{105}$ | $R^{106}$ | A α | A β | A γ | A' α | A' β | A' γ |
|---|---|---|---|---|---|---|---|---|---|---|---|---|
| A150 | H | H | H | H | A | A' | $H_2C—OH$ / —CH / $H_2C—CH_3$ | — | — | — | | ---$CH_2$-OH |
| A151 | H | H | H | H | A | A' | — | COOH | — | $H_2C—OH$ / —CH / $H_2C—CH_3$ | — | — |

TABLE 2-1
| Exemplified Compound | $R^{201}$ | $R^{202}$ | $R^{203}$ | $R^{204}$ | $R^{205}$ | $R^{206}$ | $R^{207}$ | $R^{208}$ | $R^{209}$ | $R^{210}$ | $Z^{201}$ | A α | A β | A γ |
|---|---|---|---|---|---|---|---|---|---|---|---|---|---|---|
| A201 | H | H | A | H | H | H | H | H | — | — | O | — | 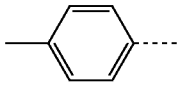 | ----$CH_2$—OH |
| A202 | H | H | A | H | H | H | H | H | — | — | O | — | 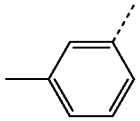 | ----$CH_2$—OH |
| A204 | H | H | A | H | H | H | H | H | — | — | O | — | 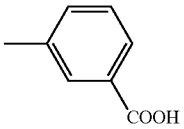 | — |
| A205 | H | H | A | H | H | H | H | H | — | — | O | — | 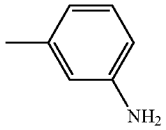 | — |
| A206 | H | H | A | H | H | H | H | H | — | — | O | — | 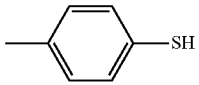 | — |
| A207 | H | H | H | H | H | H | H | H | A | — | N | — | 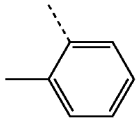 | $H_2C$—OH<br>----$CH_2$ |
| A208 | H | H | H | H | H | H | H | H | A | — | N | — | 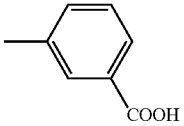 | — |

TABLE 2-1-continued
| Exemplified Compound | $R^{201}$ | $R^{202}$ | $R^{203}$ | $R^{204}$ | $R^{205}$ | $R^{206}$ | $R^{207}$ | $R^{208}$ | $R^{209}$ | $R^{210}$ | $Z^{201}$ | A α | A β | A γ |
|---|---|---|---|---|---|---|---|---|---|---|---|---|---|---|
| A209 | H | H | H | H | H | H | H | H | A | — | N | — | 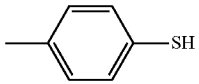 | — |
| A210 | H | H | H | H | H | H | H | H | A | — | N | 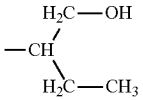 | — | — |
| A211 | $CH_3$ | H | H | H | H | H | H | $CH_3$ | A | — | N | — | 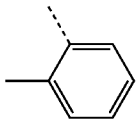 | 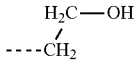 |
| A212 | H | Cl | H | H | H | H | Cl | H | A | — | N | — | 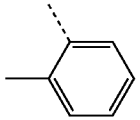 | 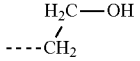 |
| A213 | H | H | 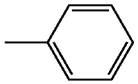 | H | H | 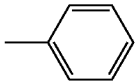 | H | H | A | — | N | — | 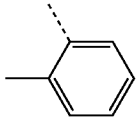 | 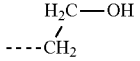 |
| A214 | H | H | 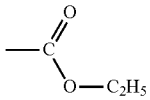 | H | H | 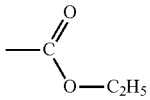 | H | H | A | — | N | — | 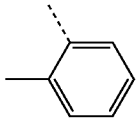 | 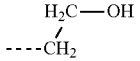 |
| A215 | H | H | H | $NO_2$ | $NO_2$ | H | H | H | A | — | N | — | 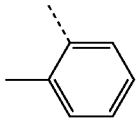 | 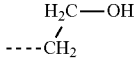 |

TABLE 2-1-continued
| Exemplified Compound | $R^{201}$ | $R^{202}$ | $R^{203}$ | $R^{204}$ | $R^{205}$ | $R^{206}$ | $R^{207}$ | $R^{208}$ | $R^{209}$ | $R^{210}$ | $Z^{201}$ | A α | A β | A γ |
|---|---|---|---|---|---|---|---|---|---|---|---|---|---|---|
| A216 | H | H | A | H | H | A | H | H | — | — | O | — | 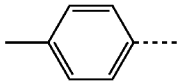 | ----$CH_2$—OH |
| A217 | H | H | A | H | H | A | H | H | — | — | O | — | 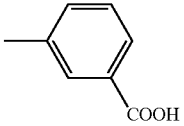 | — |

TABLE 2-2
| | | | | | | | | | | | | | | |
|---|---|---|---|---|---|---|---|---|---|---|---|---|---|---|
| A218 | H | H | A | H | H | A | H | H | — | — | O | — | 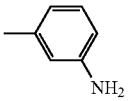 | — |
| A219 | H | H | A | H | H | A | H | H | — | — | O | — | 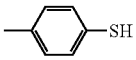 | — |
| A220 | H | H | A | H | H | A | H | H | — | — | O | 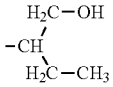 | — | — |
| A221 | H | H | A | H | H | A | H | H | — | — | O | 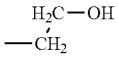 | — | — |
| A222 | H | H | A | H | H | A | H | H | — | — | O | COOH | — | — |
| A223 | H | H | A | H | H | A | H | H | — | — | O | $NH_2$ | — | — |
| A224 | H | A | H | H | H | H | A | H | — | — | O | — | 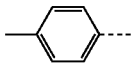 | - -$CH_2$-OH |
| A225 | H | H | A | H | H | A | H | H | CN | CN | C | — | 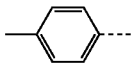 | - -$CH_2$-OH |
| A226 | H | H | A | H | H | A | H | H | CN | CN | C | — | 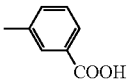 | — |
| A227 | H | H | A | H | H | A | H | H | CN | CN | C | — | 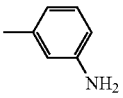 | — |
| A228 | H | H | A | H | H | A | H | H | CN | CN | C | — | 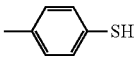 | — |
| A229 | H | H | A | H | H | A | H | H | CN | 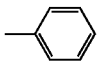 | C | — | 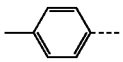 | - -$CH_2$-OH |
| A230 | H | H | A | H | H | A | H | H | 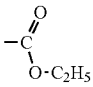 | 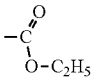 | C | — | 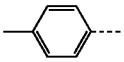 | - -$CH_2$-OH |
| A231 | H | H | H | H | H | H | H | H | A | A | C | COOH | — | — |
| A232 | H | $NO_2$ | H | H | H | H | $NO_2$ | H | A | — | N | — | 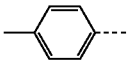 | 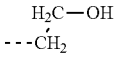 |
| A233 | H | H | H | H | H | A | H | H | — | — | O | — | 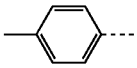 | - -$CH_2$-OH |

TABLE 3-1
| Exemplified Compound | $R^{301}$ | $R^{302}$ | $R^{303}$ | $R^{304}$ | $R^{305}$ | $R^{306}$ | $R^{307}$ | $R^{308}$ | $Z^{301}$ | A α | A β | A γ |
|---|---|---|---|---|---|---|---|---|---|---|---|---|
| A301 | H | A | H | H | H | H | — | — | O | — | 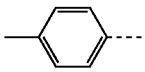 | ----$CH_2$—OH |
| A302 | H | A | H | H | H | H | — | — | O | — | 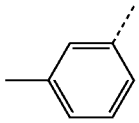 | ----$CH_2$—OH |
| A303 | H | A | H | H | H | H | — | — | O | — | 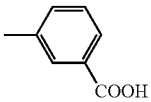 | — |
| A304 | H | A | H | H | H | H | — | — | O | — | 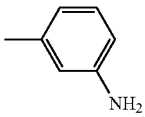 | — |
| A305 | H | A | H | H | H | H | — | — | O | — | 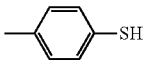 | — |
| A306 | H | H | H | H | H | H | A | — | H | — | 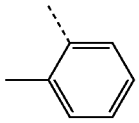 | $H_2C$—OH<br>---$CH_2$ |
| A307 | H | H | H | H | H | H | A | — | H | — | 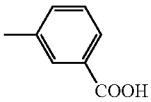 | — |
| A308 | H | H | H | H | H | H | A | — | N | $H_2C$-OH<br>—CH<br>$H_2C$-$CH_3$ | — | — |
| A309 | $CH_3$ | H | H | H | H | $CH_3$ | A | — | N | — | 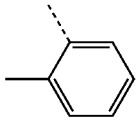 | $H_2C$—OH<br>---$CH_2$ |
| A310 | H | H | Cl | Cl | H | H | A | — | N | — | 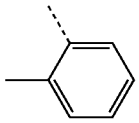 | $H_2C$—OH<br>---$CH_2$ |
| A311 | H | 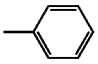 | H | H | 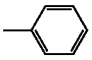 | H | A | — | N | — | 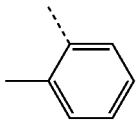 | $H_2C$—OH<br>---$CH_2$ |

TABLE 3-1-continued
| Exemplified Compound | $R^{301}$ | $R^{302}$ | $R^{303}$ | $R^{304}$ | $R^{305}$ | $R^{306}$ | $R^{307}$ | $R^{308}$ | $Z^{301}$ | A α | A β | A γ |
|---|---|---|---|---|---|---|---|---|---|---|---|---|
| A312 | H | $-C(=O)-O-C_2H_5$ | H | H | $-C(=O)-O-C_2H_5$ | H | A | — | N | — | 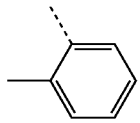 | $H_2C-OH$ / $---CH_2$ |
| A313 | H | H | H | H | H | H | A | — | N | — | 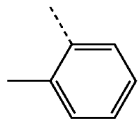 | $H_2C-OH$ / $---CH_2$ |
| A314 | H | A | H | H | A | H | — | — | O | — | 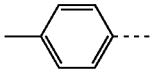 | $----CH_2-OH$ |
| A315 | H | A | H | H | A | H | — | — | O | — | 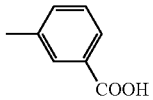 | — |
TABLE 3-2
| | | | | | | | | | | | | |
|---|---|---|---|---|---|---|---|---|---|---|---|---|
| A316 | H | A | H | H | A | H | — | — | O | — | 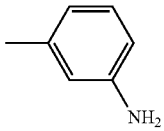 | — |
| A317 | H | A | H | H | A | H | — | — | O | — | 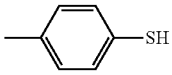 | — |
| A318 | H | A | H | H | A | H | — | — | O | $H_2C-OH$ / $-CH$ \ $H_2C-CH_3$ | — | — |
| A319 | H | A | H | H | A | H | — | — | O | $H_2C-OH$ / $-CH_2$ | — | — |
| A320 | H | A | H | H | A | H | — | — | O | COOH | — | — |
| A321 | H | A | H | H | A | H | — | — | O | $NH_2$ | — | — |
| A322 | H | H | A | A | H | H | — | — | O | — | 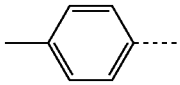 | $----CH_2-OH$ |
| A323 | H | A | H | H | A | H | CN | CN | C | — | 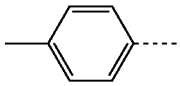 | $----CH_2-OH$ |
| A324 | H | A | H | H | A | H | CN | CN | C | — | 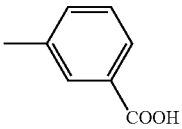 | — |

TABLE 3-2-continued

| | | | | | | | | | | | | |
|---|---|---|---|---|---|---|---|---|---|---|---|---|
| A325 | H | A | H | H | A | H | CN | CN | C | — | 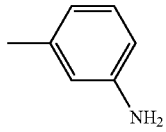 | — |
| A326 | H | A | H | H | A | H | CN | CN | C | — | 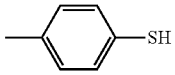 | — |
| A327 | H | A | H | H | A | H | CN | 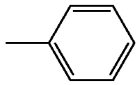 | C | — | 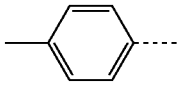 | ----$CH_2$—OH |
| A328 | H | A | H | H | A | H | 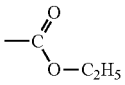 | 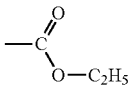 | C | — | 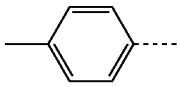 | ----$CH_2$—OH |
| A329 | H | H | H | H | H | H | A | A | C | COOH | — | — |
| A330 | H | H | H | H | H | H | A | — | N | — | 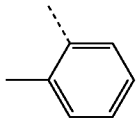 | $H_2C$—OH<br>----$CH_2$ |

TABLE 4-1

| Exemplified Compound | $R^{401}$ | $R^{402}$ | $R^{403}$ | $R^{404}$ | $R^{405}$ | $R^{406}$ |
|---|---|---|---|---|---|---|
| A401 | H | H | A | H | H | H |
| A402 | H | H | A | H | H | H |
| A403 | H | H | A | H | H | H |
| A404 | H | H | A | H | H | H |
| A405 | H | H | A | H | H | H |
| A406 | H | H | H | H | H | H |
| A407 | H | H | H | H | H | H |
| A408 | H | H | H | H | H | H |
| A409 | H | H | H | H | H | H |
| A410 | $CH_3$ | H | H | H | H | $CH_3$ |
| A411 | H | Cl | H | H | Cl | H |
| A412 | H | H | 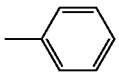 | 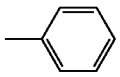 | H | H |
| A413 | H | H | 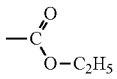 | 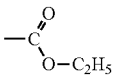 | H | H |
| A414 | H | H | H | H | H | H |
| A415 | H | H | A | A | H | H |

| Exemplified Compound | $R^{407}$ | $R^{408}$ | $Z^{401}$ | A α | A β | A γ |
|---|---|---|---|---|---|---|
| A401 | CN | CN | C | — | 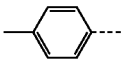 | ---$CH_2$-OH |
| A402 | CN | CN | C | — | 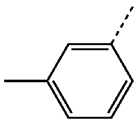 | ---$CH_2$-OH |

TABLE 4-1-continued

| | | | | | | |
|---|---|---|---|---|---|---|
| A403 | CN | CN | C | — | COOH | — |
| A404 | CN | CN | C | — | $NH_2$ | — |
| A405 | CN | CN | C | — | SH | — |
| A406 | A | — | N | — | | $H_2C—OH$ ---$CH_2$ |
| A407 | A | — | N | — | COOH | — |
| A408 | A | — | N | — | SH | — |
| A409 | — | | $H_2C-OH$ $-CH$ $H_2C-CH_3$ | — | — | |
| A410 | A | — | N | — | | $H_2C—OH$ ---$CH_2$ |
| A411 | A | — | N | — | | $H_2C—OH$ ---$CH_2$ |
| A412 | A | — | N | — | | $H_2C—OH$ ---$CH_2$ |
| A413 | A | — | N | — | | $H_2C—OH$ ---$CH_2$ |
| A414 | A | — | N | — | | $H_2C—OH$ ----$CH_2$ |
| A415 | CN | CN | C | — | | ---$CH_2$-OH |

TABLE 4-2
| | | | | | | |
|---|---|---|---|---|---|---|
| A416 | H | H | A | A | H | H |
| A417 | H | H | A | A | H | H |
| A418 | H | H | A | A | H | H |
| A419 | H | H | A | A | H | H |
| A420 | H | H | A | A | H | H |
| A421 | H | H | A | A | H | H |
| A422 | H | H | A | A | H | H |
| A423 | H | A | H | H | A | H |
| A423 | H | H | A | A | H | H |
| A424 | H | H | A | A | H | H |
| A425 | H | H | A | A | H | H |
| A426 | H | H | A | A | H | H |
| A427 | H | H | A | A | H | H |
| A428 | H | H | A | A | H | H |
| A429 | H | H | H | H | H | H |
| A430 | H | H | H | A | H | H |
| A431 | H | H | 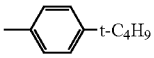 | A | H | H |
| A416 | CN | CN | C | — | 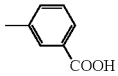 | — |
| A417 | CN | CN | C | — | 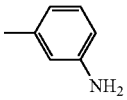 | — |
| A418 | CN | CN | C | — | 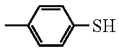 | — |
| A419 | CN | CN | C | 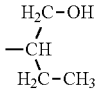 | — | — |
| A420 | CN | CN | C | 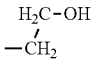 | — | — |
| A421 | CN | CN | C | COOH | — | — |
| A422 | CN | CN | C | $NH_2$ | — | — |
| A423 | CN | CN | C | — | 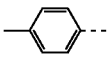 | $---CH_2-OH$ |
| A424 | — | — | O | — | 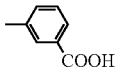 | $---CH_2-OH$ |
| A425 | — | — | O | — | 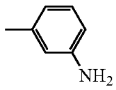 | — |
| A426 | — | — | O | — | 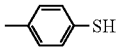 | — |
| A427 | CN | 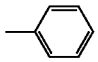 | C | — | 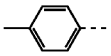 | $---CH_2-OH$ |
| A428 | 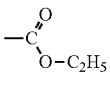 | 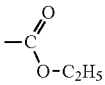 | C | — | 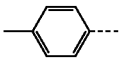 | $---CH_2-OH$ |
| A429 | A | A | C | COOH | — | — |

TABLE 4-2-continued
| | | | | | | |
|---|---|---|---|---|---|---|
| A430 | CN | CN | C | — | 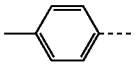 | $H_2C-OH$ <br> $---CH_2$ |
| A431 | 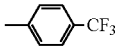 | — | N | — | 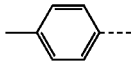 | $H_2C-OH$ <br> $----CH_2$ |

TABLE 5-1
| Exemplified Compound | $R^{501}$ | $R^{502}$ | $R^{503}$ | $R^{504}$ | $R^{505}$ | $R^{506}$ | $R^{507}$ | $R^{508}$ | $R^{509}$ | $R^{510}$ | $Z^{501}$ | A α | A β | A γ |
|---|---|---|---|---|---|---|---|---|---|---|---|---|---|---|
| A501 | H | A | H | H | H | H | H | H | CN | CN | C | — | 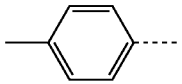 | ----$CH_2$—OH |
| A502 | H | A | H | H | H | H | H | H | CN | CN | C | — | 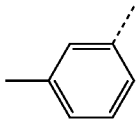 | ----$CH_2$—OH |
| A503 | H | A | H | H | H | H | H | H | CN | CN | C | — | 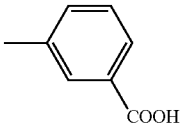 | — |
| A504 | H | A | H | H | H | H | H | H | CN | CN | C | — | 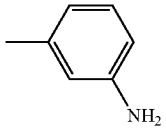 | — |
| A505 | H | A | H | H | H | H | H | H | CN | CN | C | — | 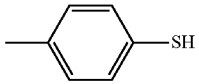 | — |
| A506 | H | $NO_2$ | H | H | $NO_2$ | H | $NO_2$ | H | A | — | N | — | 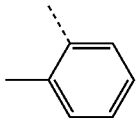 | $H_2C$—OH<br>----$CH_2$ |
| A507 | H | H | H | H | H | H | H | H | A | — | N | — | 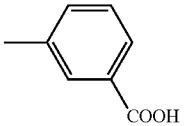 | — |

TABLE 5-1-continued
| Exemplified Compound | $R^{501}$ | $R^{502}$ | $R^{503}$ | $R^{504}$ | $R^{505}$ | $R^{506}$ | $R^{507}$ | $R^{508}$ | $R^{509}$ | $R^{510}$ | $Z^{501}$ | A α | A β | A γ |
|---|---|---|---|---|---|---|---|---|---|---|---|---|---|---|
| A508 | H | H | H | H | H | H | H | H | A | — | N | — | 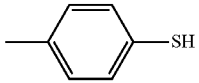 | — |
| A509 | H | H | H | H | H | H | H | H | A | — | N | 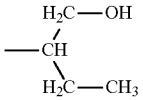 | — | — |
| A510 | $CH_3$ | H | H | H | H | H | H | $CH_3$ | A | — | N | — | 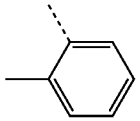 | 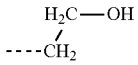 |
| A511 | H | H | Cl | H | H | Cl | H | H | A | — | N | — | 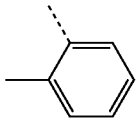 | 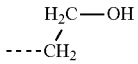 |
| A512 | H | 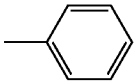 | H | H | H | H | 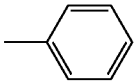 | H | A | — | N | — | 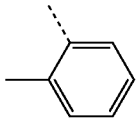 | 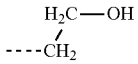 |
| A513 | H | 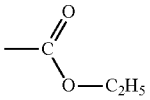 | H | H | H | H | 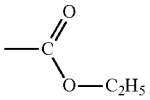 | H | A | — | N | — | 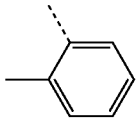 | 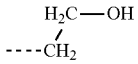 |
| A514 | H | $NO_2$ | H | H | $NO_2$ | H | $NO_2$ | H | A | — | N | — | 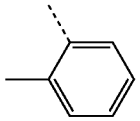 | 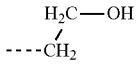 |

TABLE 5-1-continued
| Exemplified Compound | $R^{501}$ | $R^{502}$ | $R^{503}$ | $R^{504}$ | $R^{505}$ | $R^{506}$ | $R^{507}$ | $R^{508}$ | $R^{509}$ | $R^{510}$ | $Z^{501}$ | A α | A β | A γ |
|---|---|---|---|---|---|---|---|---|---|---|---|---|---|---|
| A515 | H | A | H | H | H | H | A | H | CN | CN | C | — | 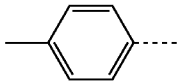 | ----$CH_2$—OH |
| A516 | H | A | H | H | H | H | A | H | CN | CN | C | — | 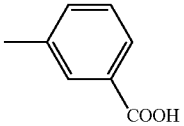 | — |

TABLE 5-2
| | | | | | | | | | | | | | | |
|---|---|---|---|---|---|---|---|---|---|---|---|---|---|---|
| A517 | H | A | H | H | H | H | A | H | CN | CN | C | — | 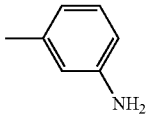 | — |
| A518 | H | A | H | H | H | H | A | H | CN | CN | C | — | 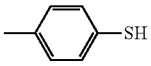 | — |
| A519 | H | A | H | H | H | H | A | H | CN | CN | C | 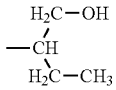 | — | — |
| A520 | H | A | H | H | H | H | A | H | CN | CN | C | 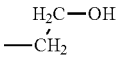 | — | — |
| A521 | H | A | H | H | H | H | A | H | CN | CN | C | COOH | — | — |
| A522 | H | A | H | H | H | H | A | H | CN | CN | C | $NH_2$ | — | — |
| A523 | H | H | A | H | H | A | H | H | CN | CN | C | — | 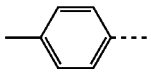 | ----$CH_2$—OH |
| A524 | H | A | H | H | H | H | A | H | — | — | O | — | 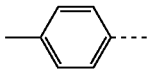 | ----$CH_2$—OH |
| A525 | H | A | H | H | H | H | A | H | — | — | O | — | 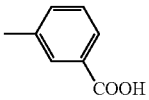 | — |
| A526 | H | A | H | H | H | H | A | H | — | — | O | — | 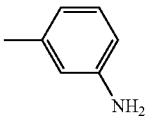 | — |
| A527 | H | A | H | H | H | H | A | H | — | — | O | — | 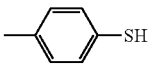 | — |
| A528 | H | A | H | H | H | H | A | H | CN | 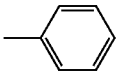 | C | — | 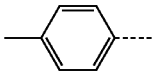 | ----$CH_2$—OH |
| A529 | H | A | H | H | H | H | A | H | 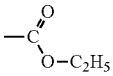 | 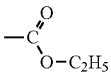 | C | — | 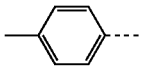 | ----$CH_2$—OH |
| A530 | H | H | H | H | H | H | H | H | A | A | C | COOH | — | — |
| A531 | H | A | H | H | H | H | A | H | CN | CN | C | — | 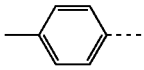 | ----$CH_2$—OH |
| A532 | H | A | H | H | H | H | — | — | 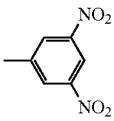 | — | N | — | 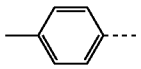 | ----$CH_2$—OH |

TABLE 6
| Exemplified Compound | $R^{601}$ | $R^{602}$ | $R^{603}$ | $R^{604}$ | $R^{605}$ | $R^{606}$ | A α | A β | A γ |
|---|---|---|---|---|---|---|---|---|---|
| A601 | A | H | H | H | H | H | — | 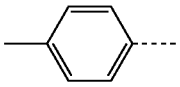 | ----$CH_2$—OH |
| A602 | A | H | H | H | H | H | — | 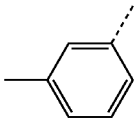 | ----$CH_2$—OH |
| A603 | A | H | H | H | H | H | — | 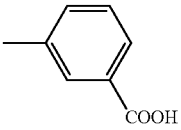 | — |
| A604 | A | H | H | H | H | H | — | 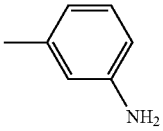 | — |
| A605 | A | H | H | H | H | H | — | 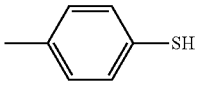 | — |
| A606 | A | H | H | H | H | H | 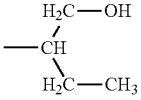 | — | — |
| A607 | A | H | H | H | H | H | 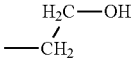 | — | — |
| A608 | A | H | H | H | H | H | COOH | — | — |
| A609 | A | H | H | H | H | H | $NH_2$ | — | — |
| A610 | A | CN | H | H | H | H | $NH_2$ | — | — |
| A611 | CN | CN | A | H | H | H | $NH_2$ | — | — |
| A612 | A | H | H | H | H | H | OH | — | — |
| A613 | H | H | A | H | H | H | OH | — | — |
| A614 | $CH_3$ | H | A | H | H | H | OH | — | — |
| A615 | H | H | A | H | H | A | OH | — | — |
| A616 | A | A | H | H | H | H | — | 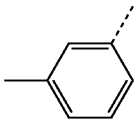 | ----$CH_2$—OH |
| A617 | A | A | H | H | H | H | 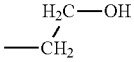 | — | — |
| A618 | A | A | H | H | H | H | 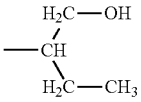 | — | — |
| A619 | A | A | H | H | H | H | COOH | — | — |

TABLE 7-1
| Exemplified Compound | $R^{701}$ | $R^{702}$ | $R^{703}$ | $R^{704}$ | $R^{705}$ | $R^{706}$ | $R^{707}$ | $R^{708}$ | A α | A β | A γ |
|---|---|---|---|---|---|---|---|---|---|---|---|
| A701 | A | H | H | H | H | H | H | H | — | 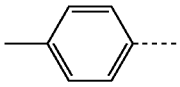 | ----$CH_2$—OH |
| A702 | A | H | H | H | H | H | H | H | — | 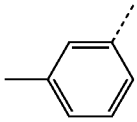 | ----$CH_2$—OH |
| A703 | A | H | H | H | H | H | H | $NO_2$ | — | 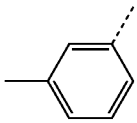 | ----$CH_2$—OH |
| A704 | A | H | H | H | H | H | H | H | — | 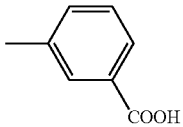 | — |
| A705 | A | H | H | H | H | H | H | H | — | 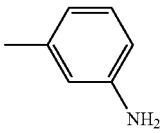 | — |
| A706 | A | H | H | H | H | H | H | H | — | 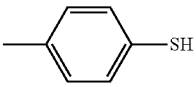 | — |
| A707 | A | H | H | H | H | H | H | H | 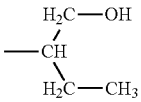 | — | — |
| A708 | A | H | H | H | H | H | H | H | COOH | — | — |
| A709 | A | H | H | H | 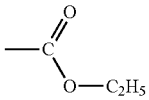 | H | H | H | COOH | — | — |
| A710 | A | H | H | H | A | H | H | H | — | 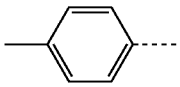 | ----$CH_2$—OH |
| A711 | A | H | H | H | A | H | H | H | — | 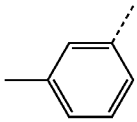 | ----$CH_2$—OH |
| A712 | A | H | H | $NO_2$ | A | H | H | $NO_2$ | — | 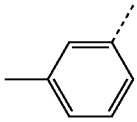 | ----$CH_2$—OH |

TABLE 7-1-continued
| Exemplified Compound | $R^{701}$ | $R^{702}$ | $R^{703}$ | $R^{704}$ | $R^{705}$ | $R^{706}$ | $R^{707}$ | $R^{708}$ | A α | A β | A γ |
|---|---|---|---|---|---|---|---|---|---|---|---|
| A713 | A | H | F | H | A | H | F | H | — | 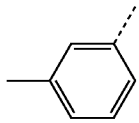 | ----$CH_2$—OH |
| A714 | A | H | H | H | A | H | H | H | — | 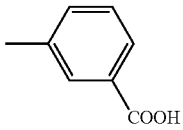 | — |
| A715 | A | H | H | H | A | H | H | H | — | 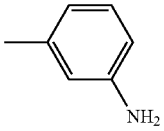 | — |
TABLE 7-2
| | | | | | | | | | | | |
|---|---|---|---|---|---|---|---|---|---|---|---|
| A716 | A | H | H | H | A | H | H | H | — | 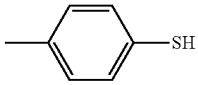 | — |
| A717 | A | H | H | H | A | H | H | H | 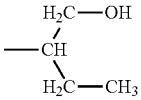 | — | — |
| A718 | A | H | H | H | A | H | H | H | COOH | — | — |
| A719 | H | A | H | H | H | A | H | H | COOH | — | — |
| A720 | A | H | H | H | A | F | H | H | COOH | — | — |
| A721 | A | H | H | $CH_3$ | $CH_3$ | H | H | H | COOH | — | — |
| A722 | A | H | H | $C_4H_9$ | $C_4H_9$ | H | H | H | COOH | — | — |
| A723 | A | H | H | 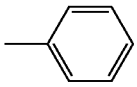 | 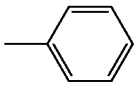 | H | H | H | COOH | — | — |
| A724 | A | H | H | $CH_3$ | $CH_3$ | H | H | H | — | 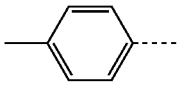 | ----$CH_2$—OH |
| A725 | A | H | H | $C_4H_9$ | $C_4H_9$ | H | H | H | — | 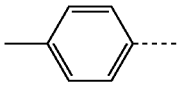 | ----$CH_2$—OH |
| A726 | A | H | H | 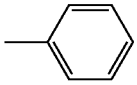 | 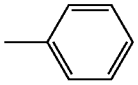 | H | H | H | — | 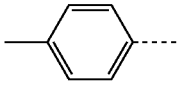 | ----$CH_2$—OH |
| A727 | A | H | H | $C_4H_9$ | $C_4H_9$ | H | H | H | — | 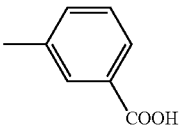 | — |

TABLE 7-2-continued
| | | | | | | | | | | | | |
|---|---|---|---|---|---|---|---|---|---|---|---|---|
| A728 | A | H | H | $C_4H_9$ | $C_4H_9$ | H | H | H | — | 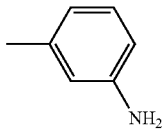 | — |
| A729 | A | H | H | $C_4H_9$ | $C_4H_9$ | H | H | H | — | 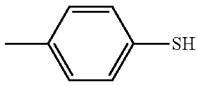 | — |
TABLE 8-1
| Exemplified Compound | $R^{801}$ | $R^{802}$ | $R^{803}$ | $R^{804}$ | $R^{805}$ | $R^{806}$ | $R^{807}$ | $R^{808}$ | $R^{809}$ | $R^{810}$ | A α | A β | A γ |
|---|---|---|---|---|---|---|---|---|---|---|---|---|---|
| A801 | H | H | H | H | H | H | H | H | 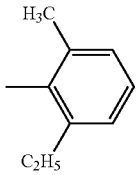 | A | 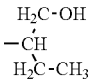 | — | — |
| A802 | H | H | H | H | H | H | H | H | 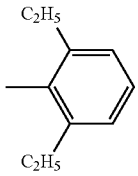 | A | 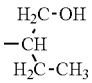 | — | — |
| A803 | H | H | H | H | H | H | H | H | 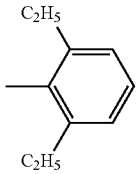 | A | — | 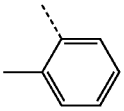 | 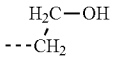 |
| A804 | H | H | H | H | H | H | H | H | 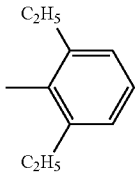 | A | — | 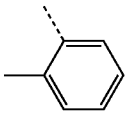 | 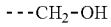 |
| A805 | H | H | H | H | H | H | H | H | 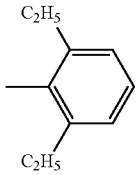 | A | — | 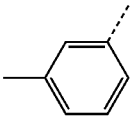 | 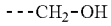 |
| A806 | H | H | H | H | H | H | H | H | 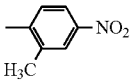 | A | 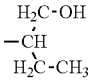 | — | — |

TABLE 8-1-continued
| Exemplified Compound | $R^{801}$ | $R^{802}$ | $R^{803}$ | $R^{804}$ | $R^{805}$ | $R^{806}$ | $R^{807}$ | $R^{808}$ | $R^{809}$ | $R^{810}$ | A α | A β | A γ |
|---|---|---|---|---|---|---|---|---|---|---|---|---|---|
| A807 | H | H | H | H | H | H | H | H | 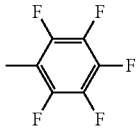 | A | 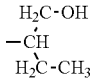 | — | — |
| A808 | H | H | H | H | H | H | H | H | 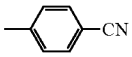 | A | 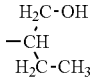 | — | — |
| A809 | H | H | H | H | H | H | H | H | 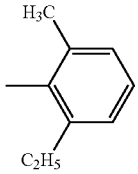 | A | $—C_5H_{10}—OH$ | — | — |
| A810 | H | H | H | H | H | H | H | H | $—C_6H_{13}$ | A | 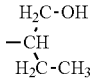 | — | — |
| A811 | H | H | H | H | H | H | H | H | 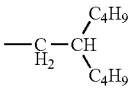 | A | — | 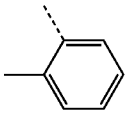 | 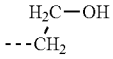 |
| A812 | H | H | H | H | H | H | H | H | 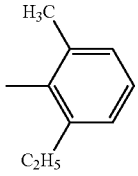 | A | — | 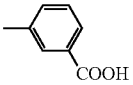 | — |
| A813 | H | H | H | H | H | H | H | H | 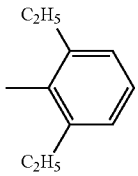 | A | — | 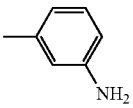 | — |
| A814 | H | H | H | H | H | H | H | H | 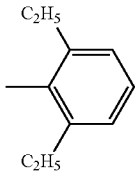 | A | — | 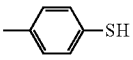 | — |

TABLE 8-1-continued
| Exemplified Compound | $R^{801}$ | $R^{802}$ | $R^{803}$ | $R^{804}$ | $R^{805}$ | $R^{806}$ | $R^{807}$ | $R^{808}$ | $R^{809}$ | $R^{810}$ | A α | A β | A γ |
|---|---|---|---|---|---|---|---|---|---|---|---|---|---|
| A815 | H | H | H | H | H | H | H | H | 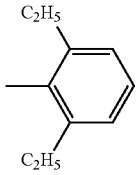 | A | — | 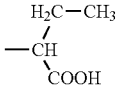 | — |
TABLE 8-2
| | | | | | | | | | |
|---|---|---|---|---|---|---|---|---|---|
| A816 | | H | H | H | H | H | H | H | |
| A817 | | H | H | H | H | H | H | H | |
| A818 | | H | H | H | H | H | H | H | |
| A819 | | H | CN | H | H | H | H | CN | |
| A820 | | H | 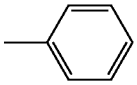 | H | H | H | H | 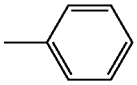 | |
| A821 | | H | A | H | H | H | H | H | |
| A822 | | H | Cl | Cl | H | H | Cl | Cl | |
| A823 | | H | H | H | H | H | H | H | |
| A824 | | H | H | H | H | H | H | H | |
| A825 | | H | H | H | H | H | H | H | |
| A826 | | H | H | H | H | H | H | H | |
| A827 | | H | H | H | H | H | H | H | |
| A828 | | H | H | H | H | H | H | H | |
| A829 | | H | H | H | H | H | H | H | |
| A830 | | H | H | H | H | H | H | H | |
| A831 | | H | 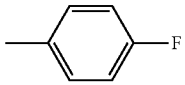 | H | H | H | H | 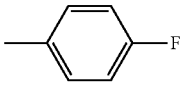 | |
| | A816 | H | 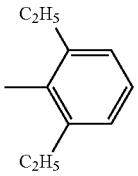 | A | — | 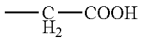 | | — | |
| | A817 | H | 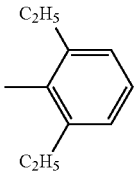 | A | — | 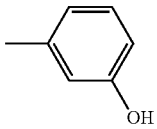 | | — | |
| | A818 | H | 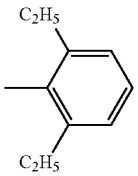 | A | — | 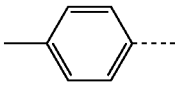 | | 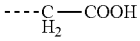 | |

TABLE 8-2-continued
| | | | | | | |
|---|---|---|---|---|---|---|
| A819 | H | 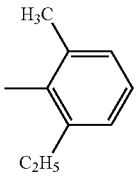 | A | 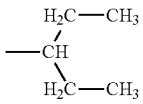 | — | — |
| A820 | H | 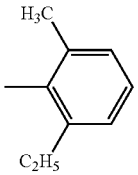 | A | 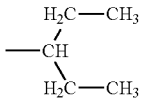 | — | — |
| A821 | H | 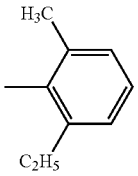 | 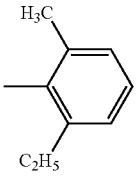 | —COOH | — | — |
| A822 | H | 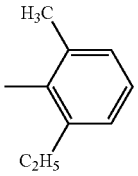 | A | 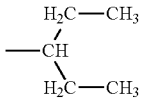 | — | — |
| A823 | H | 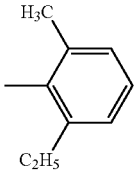 | A | 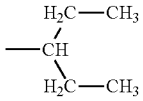 | — | — |
| A824 | H | A | A | 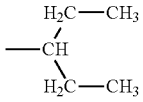 | — | — |
| A825 | H | A | A | — | 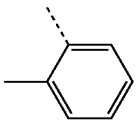 | 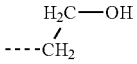 |
| A826 | H | A | A | — | 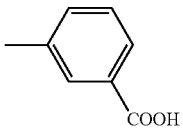 | — |
| A827 | H | A | A | — | 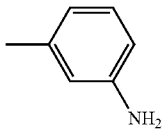 | — |

TABLE 8-2-continued

| | | | | | | |
|---|---|---|---|---|---|---|
| A828 | H | A | A | — | 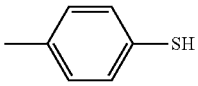 | — |
| A829 | H | A | A | — | 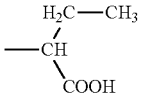 | — |
| A830 | H | A | A | — | 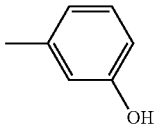 | — |
| A831 | H | 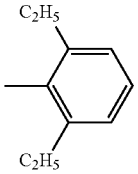 | A | — | 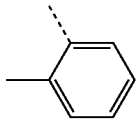 | 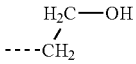 |

Of those exemplified compounds, Compound A124 or Compound A135 is a compound that exhibits an excellent positive ghost-suppressing effect.

A derivative (derivative of the electron transport substance) having a structure represented by any one of the formulae (A2) to (A6) can be purchased from Tokyo Chemical Industry Co., Ltd., Sigma-Aldrich Japan K.K., or Johnson Matthey Japan Incorporated. A derivative having a structure represented by the formula (A1) can be synthesized by a reaction between naphthalenetetracarboxylic dianhydride and a monoamine derivative that can be purchased from Tokyo Chemical Industry Co., Ltd., Sigma-Aldrich Japan K.K., or Johnson Matthey Japan Incorporated. A derivative having a structure represented by the formula (A7) can be synthesized by using a phenol derivative that can be purchased from Tokyo Chemical Industry Co., Ltd. or Sigma-Aldrich Japan K.K. as a raw material. A derivative having a structure represented by the formula (A8) can be synthesized by a reaction between perylenetetracarboxylic dianhydride and a monoamine derivative that can be purchased from Tokyo Chemical Industry Co., Ltd. or Sigma-Aldrich Japan K.K.

The compound represented by any one of the formulae (A1) to (A8) has a polymerizable functional group that can polymerize with an isocyanate group of the isocyanate compound (a hydroxy group, a thiol group, an amino group, or a carboxyl group). Two methods are each available as a method of introducing any such polymerizable functional group into the derivative having a structure represented by any one of the formulae (A1) to (A8). A first method involves directly introducing the polymerizable functional group into the derivative having a structure represented by any one of the formulae (A1) to (A8). A second method involves: synthesizing the derivative having a structure represented by any one of the formulae (A1) to (A8); and introducing a structure having the polymerizable functional group or a functional group that can serve as a precursor of the polymerizable functional group after the synthesis. Available as the second method is a method involving introducing a functional group-containing aryl group by means of a cross-coupling reaction based on a halide of the derivative having a structure represented by any one of the formulae (A1) to (A8), the reaction involving using a palladium catalyst and a base. Also available is a method involving introducing a functional group-containing alkyl group by means of a cross-coupling reaction based on the halide of the derivative having a structure represented by any one of the formulae (A1) to (A8), the reaction involving using an $FeCl_3$ catalyst and a base. Also available is a method involving subjecting the halide of the derivative having a structure represented by any one of the formulae (A1) to (A8) to lithiation, and causing an epoxy compound or $CO_2$ to act on the resultant to introduce a hydroxyalkyl group or a carboxyl group.

The isocyanate compound of the present invention is an isocyanate compound having a structure represented by the formula (1).

The isocyanate compound of the present invention is preferably such a compound that $R^1$ and $R^2$ in the formula (1) each independently represent a single bond, a methylene group, an ethylene group, or a propylene group from the viewpoint of film formability.

Next, specific examples of the isocyanate compound are given.

(2-1)

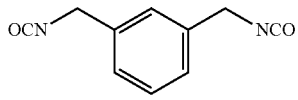

(2-2)

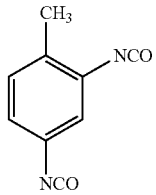

-continued (2-3)

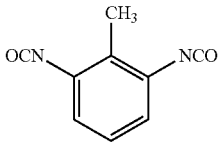

(2-4)

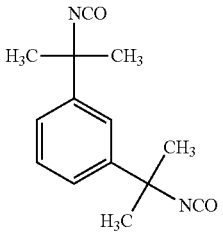

(2-5)

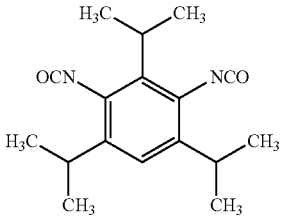

(2-6)

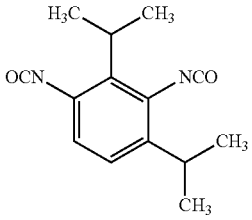

(3-1)

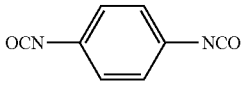

(3-2)

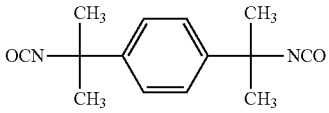

(4-1)

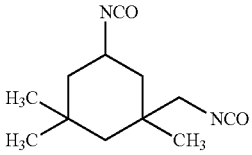

(4-2)

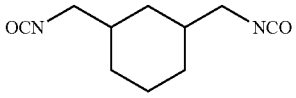

(5-1)

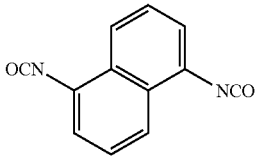

-continued (6-1)

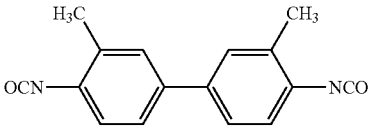

(6-2)

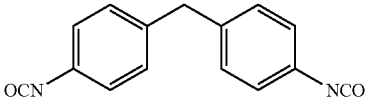

(7-1)

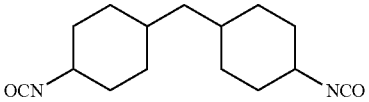

The isocyanate compound may be an isocyanate compound having an isocyanate group blocked with a blocking agent, i.e., a so-called blocked isocyanate compound.

Examples of the blocking agent for blocking an isocyanate group of the isocyanate compound include: an oxime-based compound such as formaldehyde oxime, acetaldoxime, methyl ethyl ketoxime, cyclohexanone oxime, acetone oxime, or methyl isobutyl ketoxime; an active methylene-based compound such as Meldrum's acid, dimethyl malonate, diethyl malonate, di-n-butyl malonate, ethyl acetate, or acetylacetone; an amine-based compound such as diisopropylamine, diphenylaniline, aniline, or carbazole; an imine-based compound such as ethyleneimine or polyethyleneimine; an acid imide-based compound such as succinimide or maleimide; a malonate; an imidazole-based compound such as imidazole, benzimidazole, or 2-methylimidazole; a triazole-based compound such as 1,2,3-triazole, 1,2,4-triazole, 4-amino-1,2,4-triazole, or benzotriazole; an acid amide-based compound such as acetanilide, N-methylacetamide, or acetamide; a lactam-based compound such as ϵ-caprolactam, δ-valerolactam, or γ-butyrolactam; a urea-based compound such as urea, thiourea, or ethyleneurea; a sulfite such as sodium bisulfite; a mercaptan-based compound such as butylmercaptan or dodecylmercaptan; a phenol-based compound such as phenol or cresol; a pyrazole-based compound such as pyrazole, 3,5-dimethylpyrazole, or 3-methylpyrazole; and an alcohol-based compound such as methanol, ethanol, 2-propanol, or n-butanol. In addition, only one kind of those blocking agents may be used, or two or more kinds thereof may be used in combination.

The polyvinyl acetal can be generally purchased as a resin, and examples of the resin that can be purchased include KW-1, KW-3, BX-1, and BM-1 manufactured by SEKISUI CHEMICAL CO., LTD.

It is to be noted that a polyvinyl acetal having a structural unit represented by the following formula (9), a structural unit represented by the following formula (10), and a structural unit represented by the following formula (11) is preferred.

(9)

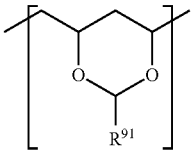

In the formula (9), $R^{91}$ represents an alkyl group having 1 to 5 carbon atoms.

(10)

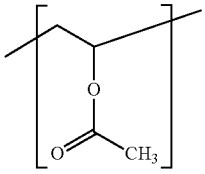

(11)

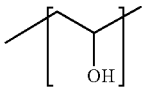

The polyacrylic polyol to be used in the undercoat layer is obtained by polymerizing a monomer component including an unsaturated monomer having a hydroxy group. Further, the polyacrylic polyol is preferably an acrylic resin having an acrylic unit or a methacrylic unit. The polyacrylic polyol can be generally purchased as a resin, and examples of the resin that can be purchased include BURNOCK WE-300 and WE-304 manufactured by DIC Corporation.

Further, the undercoat layer preferably satisfies a range represented by the following expression (8) in terms of curability, film formability, and ghost suppression.

$$0.4 \leq (iii)/(i)+(ii) \leq 1.0 \quad (8)$$

In the expression (8), (i), (ii), and (iii) represent the contents (mass ratios) of the compounds (i), (ii), and (iii) with respect to the total mass of the composition, respectively.

The photosensitive layer (the charge generation layer and the charge transport layer) is formed on the undercoat layer.

When the photosensitive layer is a laminated photosensitive layer, the charge generation layer can be formed by: applying an application liquid for the charge generation layer, which is obtained by subjecting the charge generation substance, a binder resin, and a solvent to dispersion treatment; and drying the resultant coating film. In addition, the charge generation layer may be a deposited film of the charge generation substance.

A method for the dispersion treatment is, for example, a method involving using a homogenizer, an ultrasonic dispersing machine, a ball mill, a sand mill, a roll mill, a vibration mill, an attritor, or a liquid collision-type high-speed dispersing machine.

Examples of the charge generation substance include an azo pigment, a phthalocyanine pigment, an indigo pigment, a perylene pigment, a polycyclic quinone pigment, a squarylium dye, a thiapyrylium salt, a triphenylmethane dye, a quinacridone pigment, an azulenium salt pigment, a cyanine dyestuff, an anthanthrone pigment, a pyranthrone pigment, a xanthene dye, a quinoneimine dye, and a styryl dye. Of those, an oxytitanium phthalocyanine, a chlorogallium phthalocyanine, or a hydroxygallium phthalocyanine is preferred from the viewpoint of sensitivity. In addition, out of the hydroxygallium phthalocyanines, a hydroxygallium phthalocyanine crystal of a crystal form having peaks at Bragg angles 20 in CuKα characteristic X-ray diffraction of 7.4°±0.3° and 28.2°±0.3° is preferred. In addition, only one kind of those charge generation substances may be used, or two or more kinds thereof may be used in combination.

Examples of the binder resin to be used for the charge generation layer in the case where the photosensitive layer is a laminated photosensitive layer include polycarbonate, polyester, a butyral resin, polyvinyl acetal, an acrylic resin, a vinyl acetate resin, and a urea resin. Of those, a butyral resin is preferred. In addition, only one kind of those binder resins may be used, or two or more kinds thereof may be used in combination as a mixture or a copolymer.

Examples of the solvent to be used for the application liquid for the charge generation layer include an alcohol-based solvent, a sulfoxide-based solvent, a ketone-based solvent, an ether-based solvent, an ester-based solvent, and an aromatic hydrocarbon-based solvent. In addition, only one kind of those solvents may be used, or two or more kinds thereof may be used in combination.

The thickness of the charge generation layer is preferably 0.01 μm or more and 5 μm or less, more preferably 0.1 μm or more and 2 μm or less.

In addition, various sensitizers, antioxidants, UV absorbers, plasticizers, and the like can each be incorporated into the charge generation layer as required.

In the electrophotographic photosensitive member including the laminated photosensitive layer, the charge transport layer is formed on the charge generation layer.

The charge transport layer can be formed by: applying an application liquid for the charge transport layer obtained by dissolving the charge transport substance and a binder resin in a solvent; and drying the resultant coating film.

The charge transport substance is broadly classified into a hole transport substance and an electron transport substance. Examples of the hole transport substance include a triarylamine compound, a hydrazone compound, a styryl compound, a stilbene compound, and a butadiene compound. Of those, a triarylamine compound is preferred. In addition, only one kind of those charge transport substances may be used, or two or more kinds thereof may be used in combination.

Examples of the binder resin to be used for the charge transport layer in the case where the photosensitive layer is a laminated photosensitive layer include an acrylic resin, an acrylonitrile resin, an allyl resin, an alkyd resin, an epoxy resin, a silicone resin, a phenol resin, a phenoxy resin, polyacrylamide, polyamide imide, polyamide, polyallyl ether, polyarylate, polyimide, a urethane resin, polyester, polyethylene, polycarbonate, polysulfone, polyphenylene oxide, polybutadiene, polypropylene, and a methacrylic resin. Of those, polyarylate or polycarbonate is preferred. In addition, only one kind of those binder resins may be used, or two or more kinds thereof may be used in combination as a mixture or a copolymer.

Examples of the solvent to be used for the application liquid for the charge transport layer include an alcohol-based solvent, a sulfoxide-based solvent, a ketone-based solvent, an ether-based solvent, an ester-based solvent, and an aromatic hydrocarbon-based solvent. In addition, only one kind of those solvents may be used, or two or more kinds thereof may be used in combination.

A ratio (charge transport substance/binder resin) between the charge transport substance and binder resin to be incorporated into the charge transport layer is preferably 0.3/1 or more and 10/1 or less (mass ratio).

The temperature at which the coating film of the application liquid for the charge transport layer is heated (drying temperature) is preferably 60° C. or more and 150° C. or less, more preferably 80° C. or more and 120° C. or less. In addition, the time period for which the coating film is heated (drying time) is preferably 10 minutes or more and 60 minutes or less.

When the number of the charge transport layers of the electrophotographic photosensitive member is one, the thickness of the charge transport layer is preferably 5 μm or more and 40 μm or less, more preferably 8 μm or more and 30 μm or less.

When the charge transport layer is of a laminated construction, the thickness of the charge transport layer on a support side is preferably 5 μm or more and 30 μm or less, and the thickness of the charge transport layer on a surface side is preferably 1 μm or more and 10 μm or less.

In addition, an antioxidant, a UV absorber, a plasticizer, or the like can be incorporated into the charge transport layer as required.

In addition, in the present invention, a protective layer may be formed on the photosensitive layer (charge transport layer) for the purpose of, for example, improving the durability and cleaning property of the electrophotographic photosensitive member.

The protective layer can be formed by: applying an application liquid for the protective layer obtained by dissolving a resin (or a monomer and/or oligomer thereof) in a solvent; and drying and/or curing the resultant coating film.

Examples of the resin to be used for the protective layer include polyvinyl butyral, polyester, polycarbonate, polyamide, polyimide, polyarylate, a urethane resin, an acrylic resin, a methacrylic resin, a styrene-butadiene copolymer, a styrene-acrylic acid copolymer, and a styrene-acrylonitrile copolymer. Of those, an acrylic resin or a methacrylic resin is preferred. In addition, only one kind of those resins may be used, or two or more kinds thereof may be used in combination.

In addition, in order that a charge transport ability may be imparted to the protective layer, the protective layer (second charge transport layer) may be formed by curing a monomer having a charge transport ability (hole transport ability) by means of various polymerization reactions or crosslinking reactions. Specifically, the protective layer (second charge transport layer) is preferably formed by polymerizing or crosslinking a charge-transportable compound (hole-transportable compound) having a chain polymerizable functional group to cure the compound.

Examples of the chain polymerizable functional group include an acryloyloxy group, a methacryloyloxy group, an alkoxysilyl group, and an epoxy group. A reaction for the curing is, for example, a radical polymerization reaction or an ionic polymerization reaction. In addition, heat, light such as UV light, a radiation such as an electron beam, or the like can be used at the time of the curing reaction.

Further, a conductive particle, a UV absorber, a wear resistance improver, or the like can be incorporated into the protective layer as required. Examples of the conductive particle include metal oxide particles such as a tin oxide particle. Examples of the wear resistance improver include fluorine atom-containing resin particles such as a polytetrafluoroethylene particle, alumina, and silica.

The thickness of the protective layer is preferably 0.5 μm or more and 20 μm or less, more preferably 1 μm or more and 10 μm or less.

In the application of the application liquid for each layer, there may be used, for example, an application method such as a dip coating method, a spray coating method, a spinner coating method, a roller coating method, a Mayer bar coating method, or a blade coating method.

Figure 2:
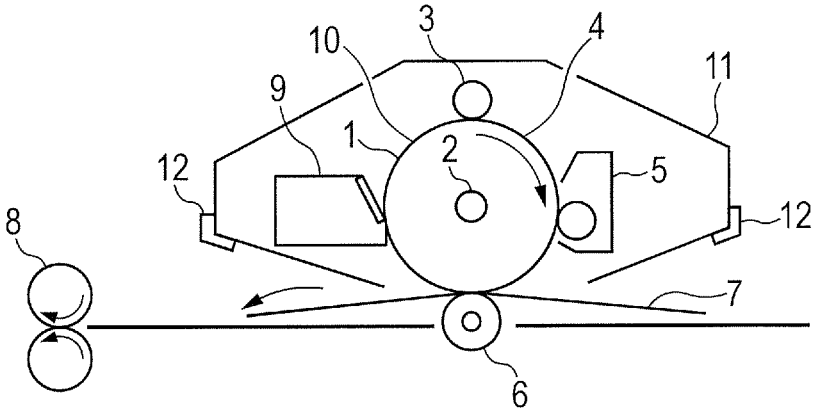
FIG. 2 is a view illustrating an example of the schematic construction of an electrophotographic apparatus including a process cartridge including the electrophotographic photosensitive member.

FIG. 2 illustrates an example of the schematic construction of an electrophotographic apparatus including a process cartridge including the electrophotographic photosensitive member of the present invention.

In FIG. 2, a cylindrical (drum-shaped) electrophotographic photosensitive member 1 of the present invention is rotationally driven about an axis 2 in a direction indicated by an arrow at a predetermined peripheral speed (process speed).

The surface (peripheral surface) of the electrophotographic photosensitive member 1 is charged to a predetermined positive or negative potential by a charging unit 3 (primary charging unit: a charging roller or the like) in a rotation process.

Next, the surface of the electrophotographic photosensitive member 1 is irradiated with exposure light (image exposure light) 4 from an exposing unit (image-exposing unit) (not shown). Thus, an electrostatic latent image is formed on the surface of the electrophotographic photosensitive member 1.

Next, the electrostatic latent image formed on the surface of the electrophotographic photosensitive member 1 is developed (normal development or reversal development) with a developer (toner) in a developing unit 5, whereby a toner image is formed on the surface of the electrophotographic photosensitive member 1. Next, the toner image formed on the surface of the electrophotographic photosensitive member 1 is transferred onto a transfer material 7 by a transferring unit 6 (such as a transfer roller).

Here, the transfer material 7 is taken out of a transfer material-supplying unit (not shown) in synchronization with the rotation of the electrophotographic photosensitive member 1, and is supplied to a space (abutment portion) between the electrophotographic photosensitive member 1 and the transferring unit 6. In addition, a voltage (transfer bias) opposite in polarity to the charge of the toner is applied from a bias power source (not shown) to the transferring unit 6.

The transfer material 7 onto which the toner image has been transferred is separated from the surface of the electrophotographic photosensitive member 1 and conveyed to a fixing unit 8, where the toner image is subjected to fixing treatment. Thus, the transfer material is printed out as an image formation product (print or copy) to the outside of the electrophotographic apparatus. The transferring unit 6 may be a transferring unit of an intermediate transfer system including, for example, a primary transfer member, an intermediate transfer member, and a secondary transfer member.

The surface of the electrophotographic photosensitive member 1 after the transfer of the toner image onto the transfer material 7 is cleaned by a cleaning unit 9 (such as a cleaning blade), whereby an adhering substance such as a transfer residual developer (transfer residual toner) is removed. In addition, the transfer residual toner can be recovered by the developing unit or the like (cleaner-less system).

Further, the surface of the electrophotographic photosensitive member 1 is subjected to antistatic treatment by being irradiated with pre-exposure light 10 from a pre-exposing unit (not shown). After that, the surface is repeatedly used in image formation. It is to be noted that when the charging unit 3 is a contact charging unit using a charging roller or the like as illustrated in FIG. 2, pre-exposure is not necessarily needed.

In the present invention, the following procedure may be adopted: two or more constituents selected from, for example, the electrophotographic photosensitive member 1, the charging unit 3, the developing unit 5, and the cleaning unit 9 are stored in a container and integrally bonded to constitute a process cartridge. In addition, the process cartridge may be removably mounted onto the main body of the electrophotographic apparatus. For example, the electrophotographic photosensitive member 1, and at least one unit selected from the group consisting of the charging unit 3, the developing unit 5, and the cleaning unit 9 are integrally supported to provide a cartridge. In addition, the cartridge can serve as a process cartridge 11 removably mounted onto the main body of the electrophotographic apparatus by using a guiding unit 12 such as the rail of the main body of the electrophotographic apparatus. Examples of the exposure light 4 include: reflected light or transmitted light from an original; and light to be applied by scanning with a laser beam, the driving of a LED array, or the driving of a liquid crystal shutter array to be performed according to a signal obtained by signalizing the original read with a sensor.

Hereinafter, the present invention is described in more detail by way of examples. It is to be noted that the term "part(s)" in the examples means "part(s) by mass." First, synthesis examples of the electron transport substance according to the present invention are described.

SYNTHESIS EXAMPLE 1

Under a nitrogen atmosphere, 5.4 parts of naphthalenetetracarboxylic dianhydride, 4 parts of 2-methyl-6-ethylaniline, and 3 parts of 2-amino-1-butanol were added to 200 parts of dimethylacetamide, and the mixture was stirred at room temperature for 1 hour to prepare a solution. After the solution had been prepared, the solution was refluxed for 8 hours, and the precipitate was separated by filtration and recrystallized with ethyl acetate to provide 1.0 part of Compound A101.

SYNTHESIS EXAMPLE 2

Under a nitrogen atmosphere, 5.4 parts of naphthalenetetracarboxylic dianhydride (manufactured by Tokyo Chemical Industry Co., Ltd.) and 5 parts of 2-aminobutyric acid (manufactured by Tokyo Chemical Industry Co., Ltd.) were added to 200 parts of dimethylacetamide, and the mixture was stirred at room temperature for 1 hour to prepare a solution. After the solution had been prepared, the solution was refluxed for 8 hours, and the precipitate was separated by filtration and recrystallized with ethyl acetate to provide 4.6 parts of Compound A128.

SYNTHESIS EXAMPLE 3

Under a nitrogen atmosphere, 5.4 parts of naphthalenetetracarboxylic dianhydride (manufactured by Tokyo Chemical Industry Co., Ltd.), 4.5 parts of 2,6-diethylaniline (manufactured by Tokyo Chemical Industry Co., Ltd.), and 4 parts of 4-aminobenzenethiol were added to 200 parts of dimethylacetamide, and the mixture was stirred at room temperature for 1 hour to prepare a solution. After the solution had been prepared, the solution was refluxed for 8 hours, and the precipitate was separated by filtration and recrystallized with ethyl acetate to provide 1.3 parts of Compound A114.

SYNTHESIS EXAMPLE 4

Under a nitrogen atmosphere, 2.5 parts of aniline (manufactured by Tokyo Chemical Industry Co., Ltd.) and 50 parts of dimethylacetamide dissolved in 50 parts of water were added to 200 parts of dimethylacetamide and 1.8 parts of naphthalenetetracarboxylic dianhydride (manufactured by Tokyo Chemical Industry Co., Ltd.) at room temperature over 2 hours. After that, the mixture was stirred at 40° C. for 1 hour and at 120° C. for 1 hour, followed by reflux for 8 hours. After dimethylacetamide had been removed by distillation under reduced pressure, 100 parts of a solution containing methanol and water at 1/1 were added to the residue to precipitate a crystal, and the crystal was separated by filtration. After the crystal had been dissolved in a mixed solution of ethyl acetate and THF, the solution was separated by silica gel column chromatography (eluent: ethyl acetate). After that, a fraction containing the target product was concentrated, and the resultant crystal was recrystallized with a mixed solution of ethyl acetate and THF to provide 1.6 parts of Compound A124. It is to be noted that THF refers to tetrahydrofuran.

SYNTHESIS EXAMPLE 5

Under a nitrogen atmosphere, 3.6 parts of amine (manufactured by Tokyo Chemical Industry Co., Ltd.) and 50 parts of dimethylacetamide were added to 200 parts of dimethylacetamide and 2.7 parts of naphthalenetetracarboxylic dianhydride (manufactured by Tokyo Chemical Industry Co., Ltd.). After that, the mixture was stirred at 120° C. for 3 hours, followed by reflux for 5 hours. After dimethylacetamide had been removed by distillation under reduced pressure, 100 parts of water were added to the residue to precipitate a crystal, and the crystal was separated by filtration. The crystal was recrystallized with ethanol to provide 3.1 parts of Compound A135.

SYNTHESIS EXAMPLE 6

7.4 Parts of 3,6-dibromo-9,10-phenanthrenedione were synthesized from 2.8 parts of 4-(hydroxymethyl)phenylboronic acid (manufactured by Sigma-Aldrich Japan K.K.) and phenanthrenequinone (manufactured by Sigma-Aldrich Japan K.K.) under a nitrogen atmosphere by a synthesis method described in Chem. Educator No. 6, 227-234 (2001). 7.4 Parts of 3,6-dibromo-9,10-phenanthrenedione were added to a mixed solvent of 100 parts of toluene and 50 parts of ethanol, and 100 parts of a 20% aqueous solution of sodium carbonate were dropped to the mixture. After that, 0.55 part of tetrakis(triphenylphosphine)palladium(0) was added to the resultant mixture and then the whole was refluxed for 2 hours. After the reaction, an organic phase was extracted with chloroform and washed with water, followed by drying with anhydrous sodium sulfate. After the solvent had been removed under reduced pressure, the residue was purified by silica gel chromatography to provide 3.2 parts of Compound A216.

SYNTHESIS EXAMPLE 7

7.4 Parts of 2,7-dibromo-9,10-phenanthrolinequinone were synthesized from 2.8 parts of 3-aminophenylboronic acid monohydrate and phenanthrolinequinone (manufactured by Sigma-Aldrich Japan K.K.) under a nitrogen atmosphere in the same manner as in Synthesis Example 6. 7.4 Parts of 2,7-dibromo-9,10-phenanthrolinequinone were added to a mixed solvent of 100 parts by mass of toluene and 50 parts by mass of ethanol, and 100 parts of a 20% aqueous solution of sodium carbonate were dropped to the mixture. After that, 0.55 part of tetrakis(triphenylphosphine)palladium(0) was added to the resultant mixture and then the whole was refluxed for 2 hours. After the reaction, an organic phase was extracted with chloroform and washed with water, followed by drying with anhydrous sodium sulfate. After the solvent had been removed under reduced pressure, the residue was purified by silica gel chromatography to provide 2.2 parts of Compound A316.

SYNTHESIS EXAMPLE 8

Under a nitrogen atmosphere, 7.4 parts of perylenetetracarboxylic dianhydride (manufactured by Tokyo Chemical Industry Co., Ltd.), 4 parts of 2,6-diethylaniline (manufactured by Tokyo Chemical Industry Co., Ltd.), and 4 parts of 2-aminophenylethanol were added to 200 parts of dimethylacetamide, and the mixture was stirred at room temperature for 1 hour to prepare a solution. After the solution had been prepared, the solution was refluxed for 8 hours, and the precipitate was separated by filtration and recrystallized with ethyl acetate to provide 5.0 parts of Compound A803.

Next, an electrophotographic photosensitive member was produced and evaluated as described below.

EXAMPLE 1

An aluminum cylinder having a length of 260.5 mm and a diameter of 30 mm (JIS-A3003, aluminum alloy) was used as a support (conductive support).

Next, 50 parts of titanium oxide particles covered with oxygen-deficient tin oxide (powder resistivity: 120 Ω·cm, tin oxide coverage: 40%), 40 parts of a phenol resin (PRIOPHEN J-325, manufactured by DIC Corporation, resin solid content: 60%), and 40 parts of methoxypropanol were loaded into a sand mill using glass beads each having a diameter of 1 mm, and the mixture was subjected to dispersion treatment for 3 hours to prepare an application liquid for a conductive layer. The application liquid for a conductive layer was applied onto the support by dip coating, and the resultant coating film was dried and thermally cured for 30 minutes at 145° C. to form a conductive layer having a thickness of 16 μm.

The average particle diameter of the titanium oxide particles covered with oxygen-deficient tin oxide in the application liquid for a conductive layer was measured by using a particle size distribution meter manufactured by HORIBA, Ltd. (trade name: CAPA700) and tetrahydrofuran as a dispersion medium at a number of rotations of 5,000 rpm by a centrifugal sedimentation method. As a result, the average particle diameter was found to be 0.33 μm.

Next, 8 parts of Exemplified Compound A101, 10 parts of the isocyanate compound (2-1), 0.1 part by mass of dioctyltin dilaurate as a catalyst, and 2 parts of a polyvinyl acetal (trade name: BM-1, manufactured by SEKISUI CHEMICAL CO., LTD.) were dissolved in a mixed solvent of 100 parts of dimethylacetamide and 100 parts of methyl ethyl ketone to prepare an application liquid for an undercoat layer. The application liquid for an undercoat layer was applied onto the conductive layer by dip coating, and the resultant coating film was cured (polymerized) by being heated for 30 minutes at 160° C. Thus, an undercoat layer having a thickness of 0.5 μm was formed.

Next, 10 parts of a Y-type oxotitanium phthalocyanine crystal (charge generation substance), 5 parts of a polyvinyl butyral resin (trade name: S-LEC BX-1, manufactured by SEKISUI CHEMICAL CO., LTD.), and 260 parts of cyclohexanone were loaded into a sand mill using glass beads each having a diameter of 1 mm, and the mixture was subjected to dispersion treatment for 1.5 hours. Next, 240 parts of ethyl acetate were added to the resultant to prepare an application liquid for a charge generation layer. The application liquid for a charge generation layer was applied onto the undercoat layer by dip coating, and the resultant coating film was dried for 10 minutes at 95° C. to form a charge generation layer having a thickness of 0.3 μm.

Next, 50 parts of an amine compound (hole transport substance) represented by the following formula (B), 50 parts of an amine compound (hole transport substance) represented by the following formula (C), and 100 parts of polycarbonate (trade name: Iupilon 2400, manufactured by MITSUBISHI GAS CHEMICAL COMPANY, INC.) were dissolved in a mixed solvent of 350 parts of xylene and 250 parts of dimethoxymethane to prepare an application liquid for a charge transport layer.

(B)

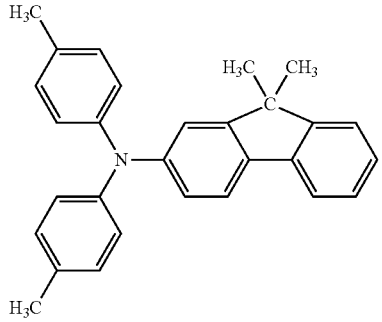

(C)

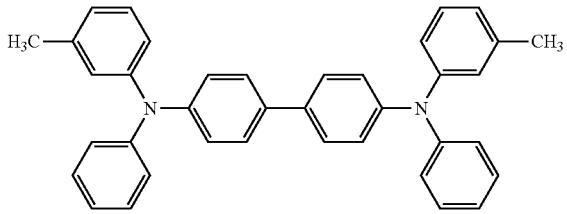

Thus, an electrophotographic photosensitive member including, on the support, the conductive layer, the undercoat layer, the charge generation layer, and the hole transport layer was produced.

The produced electrophotographic photosensitive member was mounted onto a reconstructed machine of a laser beam printer (trade name: LBP-2510) manufactured by Canon Inc. under an environment having a temperature of 15° C. and a humidity of 10% RH, followed by the measurement of its surface potential and the evaluation of an output image. Details about the foregoing are as described below.

Measurement for surface potential evaluation was performed as described below. First, the process cartridge for a cyan color of the laser beam printer was reconstructed and a potential probe (model 6000B-8: manufactured by TREK JAPAN) was mounted at a development position. Then, a potential at the central portion of the electrophotographic photosensitive member was measured with a surface potentiometer (model 344: manufactured by TREK JAPAN). During the measurement of the surface potential of a drum, the light quantity of image exposure was set so that an initial dark portion potential (Vd) became −500 V and an initial light portion potential (Vl) became −100 V.

Subsequently, the produced electrophotographic photosensitive member was mounted onto the process cartridge for a cyan color of the laser beam printer, and the process cartridge was mounted onto a cyan process cartridge station, followed by the output of an image. First, one solid white image, five images for a ghost evaluation, one solid black image, and five images for a ghost evaluation were continuously output in the stated order. Next, a full-color image (such a character image that the print percentage of each color was 1%) was output on 10,000 sheets of A4 size plain paper. After that, one solid white image, five images for a ghost evaluation, one solid black image, and five images for a ghost evaluation were continuously output in the stated order.

Figure 3:
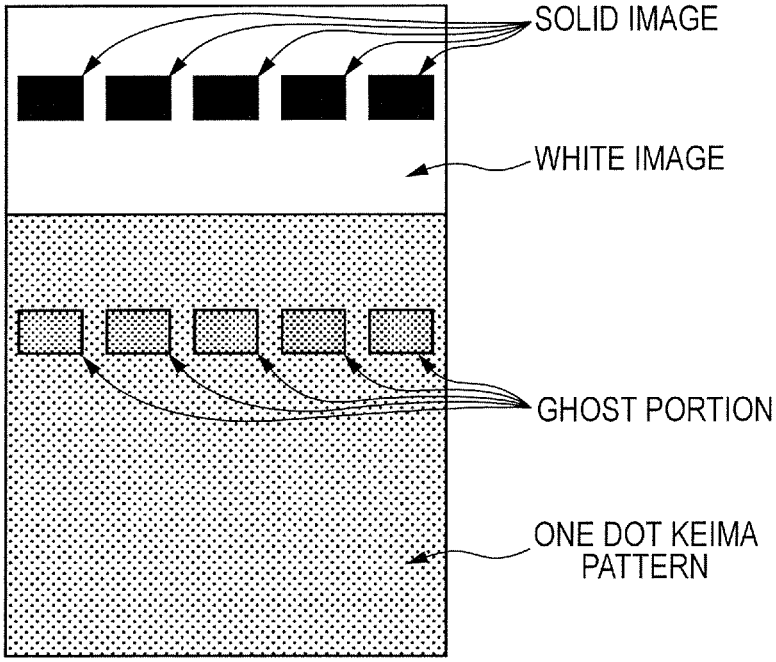
FIG. 3 is a view illustrating an image for a ghost evaluation in the present invention.
Figure 4:
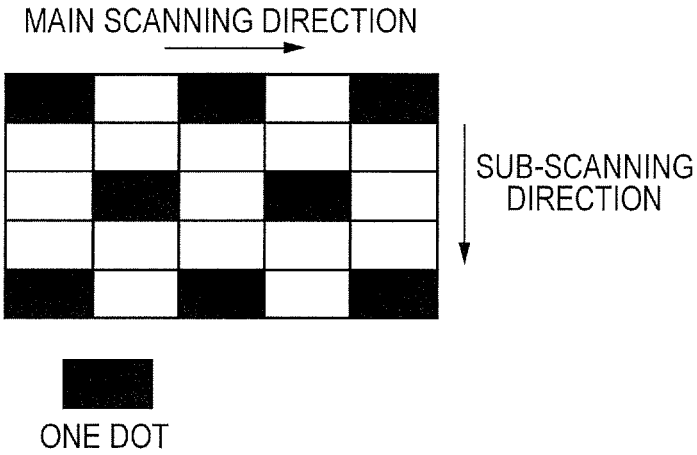
FIG. 4 is a view illustrating a halftone image of a one dot keima pattern in the present invention.

Each image for a ghost evaluation is obtained by: outputting a quadrangular "solid image" in a "white image" at the leading end of an image as illustrated in FIG. 3; and producing a "halftone image of a one dot keima pattern" illustrated in FIG. 4 after the output. It is to be noted that a "ghost" portion in FIG. 3 is a portion where a ghost resulting from the "solid image" may appear.

An evaluation for a positive ghost was performed by measuring a difference between the image density of the halftone image of a one dot keima pattern and the image density of the ghost portion. The density difference was measured at ten sites in one image for a ghost evaluation with a spectral densitometer (trade name: X-Rite 504/508, manufactured by X-Rite). The operation was performed for all of the ten images for a ghost evaluation, and the average of a total of 100 measured values was calculated to evaluate a Macbeth density difference (initial stage) at the time of the output of the initial image. Next, a fluctuation in Macbeth density difference was determined by calculating a difference (change) between the Macbeth density difference after the output on the 10,000 sheets and the Macbeth density difference at the time of the output of the initial image. A smaller Macbeth density difference means that a positive ghost is suppressed to a larger extent. In addition, a smaller difference between the Macbeth density difference after the output on the 10,000 sheets and the Macbeth density difference at the time of the output of the initial image means that a change in positive ghost is smaller. Table 9 shows the results. A Macbeth density difference of less than 0.05 was regarded as the case where the ghost-suppressing effect of the present invention was obtained.

EXAMPLES 2 to 56

Electrophotographic photosensitive members were produced in the same manner as in Example 1 with the exception that in Example 1, the kinds and contents of (i) the isocyanate compound, (ii) the resin, and (iii) the electron transport substance were changed as shown in Table 9, and evaluations for positive ghosts were similarly performed. Table 9 shows the results.

TABLE 9

| Example | (i) Isocyanate compound | (i) Part(s) by mass | (ii) Resin | (ii) Part(s) by mass | (iii) Electron-transport substance | (iii) Part(s) by mass | Macbeth density (change) | Macbeth density difference (intial stage) |
|---|---|---|---|---|---|---|---|---|
| 1 | (2-1) | 10 | BM-1 | 2 | A101 | 8 | 0.002 | 0.021 |
| 2 | (2-2) | 10 | BM-1 | 2 | A101 | 8 | 0.002 | 0.023 |
| 3 | (2-3) | 10 | BM-1 | 2 | A101 | 8 | 0.002 | 0.026 |
| 4 | (2-4) | 11 | BM-1 | 2 | A101 | 8 | 0.003 | 0.020 |
| 5 | (2-5) | 11 | BM-1 | 2 | A101 | 8 | 0.002 | 0.022 |
| 6 | (3-1) | 9 | BM-1 | 2 | A101 | 8 | 0.002 | 0.020 |
| 7 | (3-2) | 10 | BM-1 | 2 | A101 | 8 | 0.004 | 0.024 |
| 8 | (4-1) | 10 | BM-1 | 2 | A101 | 8 | 0.002 | 0.028 |
| 9 | (4-2) | 10 | BM-1 | 2 | A101 | 8 | 0.002 | 0.021 |
| 10 | (5-1) | 15 | BM-1 | 2 | A101 | 10 | 0.004 | 0.021 |
| 11 | (6-1) | 15 | BM-1 | 2 | A101 | 10 | 0.002 | 0.020 |
| 12 | (6-2) | 15 | BM-1 | 2 | A101 | 10 | 0.002 | 0.025 |
| 13 | (7-1) | 12 | BM-1 | 2 | A101 | 8 | 0.004 | 0.026 |
| 14 | (2-1) | 10 | BURNOCK WE-300 | 2 | A101 | 8 | 0.002 | 0.022 |
| 15 | (2-2) | 10 | BURNOCK WE-300 | 2 | A101 | 8 | 0.003 | 0.020 |
| 16 | (2-3) | 10 | BURNOCK WE-300 | 2 | A101 | 8 | 0.003 | 0.029 |
| 17 | (2-4) | 11 | BURNOCK WE-300 | 2 | A101 | 8 | 0.003 | 0.030 |
| 18 | (2-5) | 11 | BURNOCK WE-300 | 2 | A101 | 8 | 0.004 | 0.031 |
| 19 | (3-1) | 9 | BURNOCK WE-300 | 2 | A101 | 8 | 0.002 | 0.028 |
| 20 | (3-2) | 10 | BURNOCK WE-300 | 2 | A101 | 8 | 0.004 | 0.029 |
| 21 | (4-1) | 10 | BURNOCK WE-300 | 2 | A101 | 8 | 0.002 | 0.022 |
| 22 | (4-2) | 10 | BURNOCK WE-300 | 2 | A101 | 8 | 0.004 | 0.029 |
| 23 | (5-1) | 15 | BURNOCK WE-300 | 2 | A101 | 10 | 0.002 | 0.020 |
| 24 | (6-1) | 15 | BURNOCK WE-300 | 2 | A101 | 10 | 0.002 | 0.021 |
| 25 | (6-2) | 15 | BURNOCK WE-300 | 2 | A101 | 10 | 0.004 | 0.027 |
| 26 | (7-1) | 12 | BURNOCK WE-300 | 2 | A101 | 8 | 0.002 | 0.020 |
| 27 | (2-1) | 10 | BM-1 | 2 | A103 | 8 | 0.002 | 0.021 |
| 28 | (2-1) | 10 | BM-1 | 2 | A112 | 8 | 0.002 | 0.020 |
| 29 | (2-1) | 10 | BM-1 | 2 | A112 | 8 | 0.002 | 0.020 |
| 30 | (2-1) | 10 | BM-1 | 2 | A112 | 8 | 0.004 | 0.024 |
| 31 | (2-1) | 10 | BM-1 | 2 | A128 | 8 | 0.002 | 0.025 |
| 32 | (2-1) | 10 | BM-1 | 2 | A134 | 8 | 0.002 | 0.020 |
| 33 | (2-1) | 10 | BM-1 | 2 | A141 | 8 | 0.002 | 0.021 |
| 34 | (2-1) | 10 | BM-1 | 2 | A216 | 7 | 0.003 | 0.021 |
| 35 | (2-1) | 10 | BM-1 | 2 | A217 | 7 | 0.002 | 0.022 |
| 36 | (2-1) | 10 | BM-1 | 2 | A218 | 7 | 0.002 | 0.021 |
| 37 | (2-1) | 10 | BM-1 | 2 | A315 | 7 | 0.004 | 0.020 |
| 38 | (2-1) | 10 | BM-1 | 2 | A316 | 7 | 0.002 | 0.020 |
| 39 | (2-1) | 10 | BM-1 | 2 | A317 | 7 | 0.003 | 0.022 |
| 40 | (2-1) | 10 | BM-1 | 2 | A412 | 7 | 0.003 | 0.026 |
| 41 | (2-1) | 10 | BM-1 | 2 | A514 | 7 | 0.003 | 0.022 |
| 42 | (2-1) | 10 | BM-1 | 2 | A515 | 7 | 0.003 | 0.025 |
| 43 | (2-1) | 10 | BM-1 | 2 | A610 | 7 | 0.003 | 0.023 |
| 44 | (2-1) | 10 | BM-1 | 2 | A725 | 12 | 0.005 | 0.035 |
| 45 | (7-1) | 10 | BM-1 | 2 | A725 | 5 | 0.032 | 0.042 |
| 46 | (7-1) | 10 | BM-1 | 2 | A725 | 8 | 0.004 | 0.025 |

TABLE 9-continued

| Example | (i) Isocyanate compound | (i) Part(s) by mass | (ii) Resin | (ii) Part(s) by mass | (iii) Electron-transport substance | (iii) Part(s) by mass | Macbeth density (change) | Macbeth density difference (intial stage) |
|---|---|---|---|---|---|---|---|---|
| 47 | (2-4) | 10 | BURNOCK WE-304 | 2 | A101 | 8 | 0.002 | 0.026 |
| 48 | (2-5) | 10 | KW-1 | 2 | A101 | 8 | 0.003 | 0.020 |
| 49 | (3-1) | 10 | BM-1 | 2 | A102 | 8 | 0.003 | 0.024 |
| 50 | (3-2) | 10 | BM-1 | 2 | A103 | 8 | 0.004 | 0.027 |
| 51 | (4-1) | 10 | BM-1 | 2 | A216 | 8 | 0.003 | 0.024 |
| 52 | (4-2) | 10 | BM-1 | 2 | A317 | 8 | 0.003 | 0.029 |
| 53 | (5-1) | 10 | BM-1 | 2 | A412 | 8 | 0.003 | 0.023 |
| 54 | (6-1) | 10 | BM-1 | 2 | A515 | 8 | 0.003 | 0.020 |
| 55 | (6-2) | 10 | BM-1 | 2 | A610 | 8 | 0.003 | 0.023 |
| 56 | (7-1) | 10 | BM-1 | 2 | A128 | 8 | 0.003 | 0.022 |

COMPARATIVE EXAMPLE 1

An electrophotographic photosensitive member was produced in the same manner as in Example 1 except that in Example 1, 2 parts of the polyvinyl acetal (trade name: BM-1, manufactured by SEKISUI CHEMICAL CO., LTD.) were changed to 2 parts of poly(p-hydroxystyrene) (trade name: MARUKA LYNCUR, manufactured by Maruzen Petrochemical Co., Ltd.). In addition, an evaluation for a ghost was similarly performed. Table 10 shows the results.

COMPARATIVE EXAMPLE 2

An electrophotographic photosensitive member was produced in the same manner as in Example 1 except that in Example 1, 10 parts of the isocyanate compound (2-1) were changed to 10 parts of hexamethylene diisocyanate, and an evaluation for a ghost was similarly performed. Table 10 shows the results.

COMPARATIVE EXAMPLE 3

An electrophotographic photosensitive member was produced in the same manner as in Example 1 except that in Example 1, 8 parts of Compound A101 were changed to 8 parts of alizarin, and an evaluation for a ghost was similarly performed. Table 10 shows the results.

COMPARATIVE EXAMPLE 4

In Example 1, 2 parts of the polyvinyl acetal (trade name: BM-1, manufactured by SEKISUI CHEMICAL CO., LTD.) were changed to 2 parts of an acrylic polyol resin (trade name: BURNOCK WE-300, manufactured by DIC Corporation), and parts of Compound A101 were changed to 8 parts of alizarin. An electrophotographic photosensitive member was produced in the same manner as in Example 1 except the foregoing, and an evaluation for a ghost was similarly performed. Table 10 shows the results.

COMPARATIVE EXAMPLE 5

In Example 1, 10 parts of the isocyanate compound (2-1) were changed to 10 parts of hexamethylene diisocyanate, and 8 parts of Compound A101 were changed to 8 parts of alizarin. An electrophotographic photosensitive member was produced in the same manner as in Example 1 except the foregoing, and an evaluation for a ghost was similarly performed. Table 10 shows the results.

TABLE 10

| Comparative Example | (i) Isocyanate compound | (i) Part(s) by mass | (ii) Resin | (ii) Part(s) by mass | (iii) Electron-transport substance | (iii) Part(s) by mass | Macbeth density (change) | Macbeth density difference (initial stage) |
|---|---|---|---|---|---|---|---|---|
| 1 | (2-1) | 10 | p-Hydroxystyrene | 2 | A101 | 8 | 0.042 | 0.051 |
| 2 | HDI | 10 | BM-1 | 2 | A101 | 8 | 0.039 | 0.051 |
| 3 | (2-1) | 10 | BM-1 | 2 | Alizarin | 8 | 0.044 | 0.061 |
| 4 | (2-1) | 10 | BURNOCK WE-300 | 2 | Alizarin | 8 | 0.042 | 0.063 |
| 5 | HDI | 10 | BM-1 | 2 | Alizarin | 8 | 0.047 | 0.055 |

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2013-270560, filed Dec. 26, 2013 and Japanese Patent Application No. 2014-240036, filed Nov. 27, 2014 which are hereby incorporated by reference herein in their entirety.

What is claimed is:

1. An electrophotographic photosensitive member, comprising:

a support;

an undercoat layer formed on the support; and a photosensitive layer formed on the undercoat layer, wherein the undercoat layer comprises a cured product of a composition comprising (i) an isocyanate compound represented by the following formula (1), (ii) at least one resin selected from the group consisting of a polyvinyl acetal and an acrylic polyol, and (iii) a compound represented by any one of the following formulae (A1) to (A8):

(1)

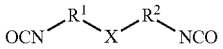

in the formula (1), $R^1$ and $R^2$ each independently represent a single bond or an alkylene group having 1 to 6 carbon atoms, and X represents a bivalent group represented by any one of the following formulae (2) to (7):

(2)

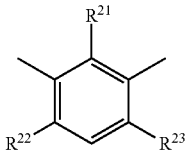

(3)

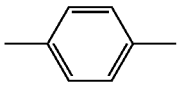

(4)

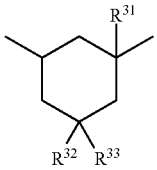

(5)

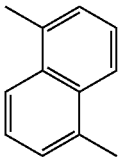

(6)

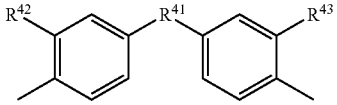

(7)

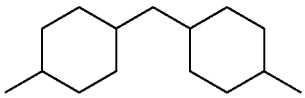

in the formulae (2) to (7), $R^{21}$, $R^{22}$, $R^{23}$, $R^{31}$, $R^{32}$, $R^{33}$, $R^{42}$ and $R^{43}$ each independently represent a hydrogen atom or a methyl group, and $R^{41}$ represent a single bond or a methylene group;

(A1)

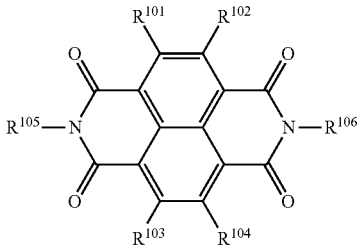

(A2)

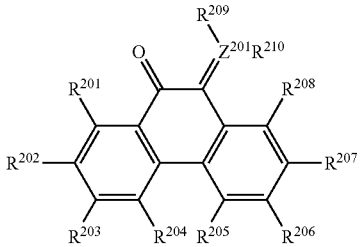

(A3)

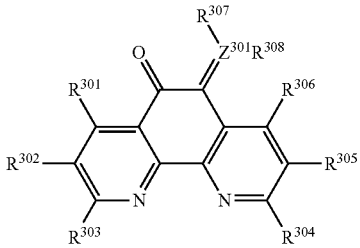

(A4)

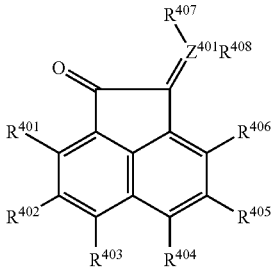

(A5)

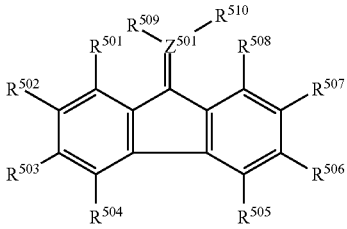

(A6)

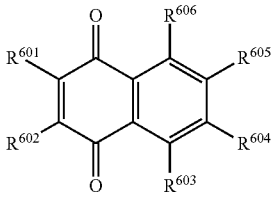

-continued (A7)

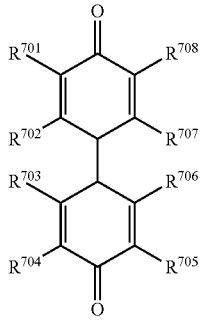

(A8)

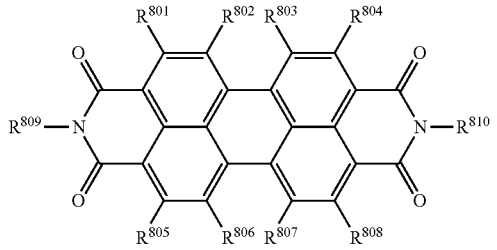

in the formulae (A1) to (A8):

$R^{101}$ to $R^{106}$, $R^{201}$ to $R^{210}$, $R^{301}$ to $R^{308}$, $R^{401}$ to $R^{408}$, $R^{501}$ to $R^{510}$, $R^{601}$ to $R^{606}$, $R^{701}$ to $R^{708}$, and $R^{801}$ to $R^{810}$ each independently represent a monovalent group represented by the following formula (A), a hydrogen atom, a cyano group, a nitro group, a halogen atom, an alkoxycarbonyl group, an unsubstituted or substituted alkyl group, a group derived by substituting one of carbon atoms in a main chain of the unsubstituted or substituted alkyl group with an oxygen atom, a group derived by substituting one of the carbon atoms in the main chain of the unsubstituted or substituted alkyl group with a sulfur atom, a group derived by substituting one of the carbon atoms in the main chain of the unsubstituted or substituted alkyl group with $NR^{10}$, or an unsubstituted or substituted aryl group, and $R^{10}$ represents a hydrogen atom or an alkyl group, provided that at least one of $R^{101}$ to $R^{106}$, at least one of $R^{201}$ to $R^{210}$, at least one of $R^{301}$ to $R^{308}$, at least one of $R^{401}$ to $R^{408}$, at least one of $R^{501}$ to $R^{510}$, at least one of $R^{601}$ to $R^{606}$, at least one of $R^{701}$ to $R^{708}$, and at least one of $R^{801}$ to $R^{810}$ each represent the monovalent group represented by the formula (A);

a substituent of the substituted alkyl group is an alkyl group, an aryl group, or a halogen atom, and a substituent of the substituted aryl group comprises a halogen atom, a nitro group, a cyano group, an alkyl group, or a halogenated alkyl group;

$Z^{201}$, $Z^{301}$, $Z^{401}$, and $Z^{501}$ each independently represent a carbon atom, a nitrogen atom, or an oxygen atom;

$R^{209}$ and $R^{210}$ are absent when $Z^{201}$ represents the oxygen atom, and $R^{210}$ is absent when $Z^{201}$ represents the nitrogen atom;

$R^{307}$ and $R^{308}$ are absent when $Z^{301}$ represents the oxygen atom, and $R^{308}$ is absent when $Z^{301}$ represents the nitrogen atom;

$R^{407}$ and $R^{408}$ are absent when $Z^{401}$ represents the oxygen atom, and $R^{408}$ is absent when $Z^{401}$ represents the nitrogen atom; and $R^{509}$ and $R^{510}$ are absent when $Z^{501}$ represents the oxygen atom, and $R^{510}$ is absent when $Z^{501}$ represents the nitrogen atom:

(A)

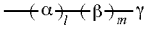

in the formula (A):

at least one of α, β, and γ represents a group having a polymerizable functional group, and the polymerizable functional group comprises at least one kind of group selected from the group consisting of a hydroxy group, a thiol group, an amino group, and a carboxyl group;

l and m each independently represent 0 or 1, and a sum of l and m is 0 or more and 2 or less;

α represents an unsubstituted or substituted alkylene group having 1 to 6 main-chain carbon atoms, a group derived by substituting one of the carbon atoms in a main chain of the unsubstituted or substituted alkylene group having 1 to 6 main-chain carbon atoms with an oxygen atom, a group derived by substituting one of the carbon atoms in the main chain of the unsubstituted or substituted alkylene group having 1 to 6 main-chain carbon atoms with a sulfur atom, or a group derived by substituting one of the carbon atoms in the main chain of the unsubstituted or substituted alkylene group having 1 to 6 main-chain carbon atoms with $NR^{19}$, and each of the groups represented by α may have the polymerizable functional group;

$R^{19}$ represents a hydrogen atom or an alkyl group;

a substituent of the substituted alkylene group is an alkyl group having 1 to 6 carbon atoms, a benzyl group, an alkoxycarbonyl group, or a phenyl group;

β represents a phenylene group, a phenylene group substituted with an alkyl group having 1 to 6 carbon atoms, a phenylene group substituted with a nitro group, a phenylene group substituted with a halogen atom, or a phenylene group substituted with an alkoxy group, and each of the groups represented by β may have the polymerizable functional group; and γ represents a hydrogen atom, an alkyl group having 1 to 6 main-chain carbon atoms, or an alkyl group having 1 to 6 main-chain carbon atoms and substituted with an alkyl group having 1 to 6 carbon atoms, and each of the groups represented by γ may have the polymerizable functional group.

2. An electrophotographic photosensitive member according to claim 1, wherein the undercoat layer satisfies the following expression (8):

$$0.4 \leq (iii)/(i)+(ii) \leq 1.0 \quad (8)$$

in the expression (8), (i), (ii), and (iii) represent contents of the compounds (i), (ii), and (iii) with respect to a total mass of the composition, respectively.

3. An electrophotographic photosensitive member according to claim 1, wherein $R^1$ and $R^2$ in the formula (1) each independently represent a single bond, a methylene group, an ethylene group, or a propylene group.

4. An electrophotographic photosensitive member according to claim 1, wherein the polyvinyl acetal in the (ii) has a structural unit represented by the following formula (9), a structural unit represented by the following formula (10), and a structural unit represented by the following formula (11):

(9)

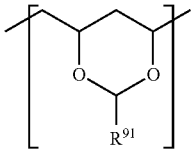

in the formula (9), $R^{91}$ represents an alkyl group having 1 to 5 carbon atoms.

(10)

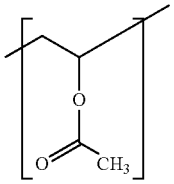

(11)

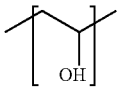

5. An electrophotographic photosensitive member according to claim 1, wherein the acrylic polyol in the (ii) comprises an acrylic resin that is obtained by polymerizing a monomer component including an unsaturated monomer having a hydroxy group, and has one of an acrylic unit and a methacrylic unit.

6. A process cartridge, comprising:

the electrophotographic photosensitive member according to claim 1; and at least one unit selected from the group consisting of a charging unit, a developing unit, and a cleaning unit, the process cartridge integrally supporting the electrophotographic photosensitive member and the at least one unit, the process cartridge being removably mounted onto a main body of an electrophotographic apparatus.

7. An electrophotographic apparatus, comprising:

the electrophotographic photosensitive member according to claim 1;

a charging unit;

an exposing unit;

a developing unit; and a transferring unit.

8. A method of producing an electrophotographic photosensitive member comprising:

a support;

an undercoat layer formed on the support; and a photosensitive layer formed on the undercoat layer, the method comprising the steps of:

preparing an application liquid for the undercoat layer, the application liquid comprising a composition comprising (i) an isocyanate compound having a structure represented by the following formula (1), (ii) at least one resin selected from the group consisting of a polyvinyl acetal and an acrylic polyol, and (iii) a compound represented by any one of the following formulae (A1) to (A8); and forming a coating film of the application liquid for the undercoat layer, followed by drying and curing of the coating film to form the undercoat layer:

(1)

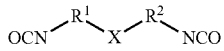

in the formula (1), $R^1$ and $R^2$ each independently represent a single bond or an alkylene group having 1 to 6 carbon atoms, and X represents a bivalent group represented by any one of the following formulae (2) to (7):

(2)

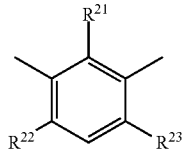

(3)

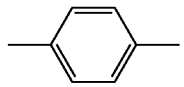

(4)

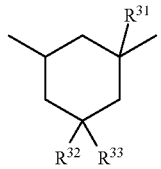

(5)

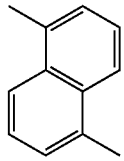

(6)

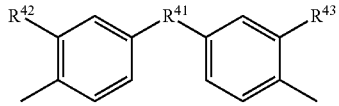

(7)

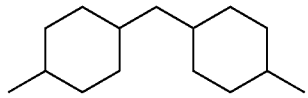

in the formulae (2) to (7), $R^{21}$, $R^{22}$, $R^{23}$, $R^{31}$, $R^{32}$, $R^{33}$, $R^{42}$, and $R^{43}$ each independently represent a hydrogen atom or a methyl group, and $R^{41}$ represents a single bond or a methylene group;

(A1)

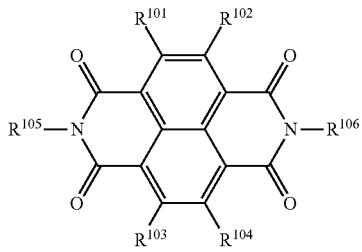

-continued (A2)

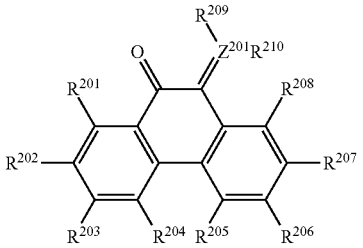

(A3)

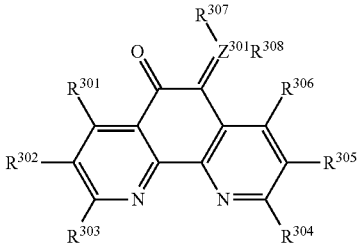

(A4)

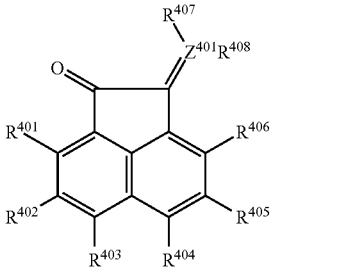

(A5)

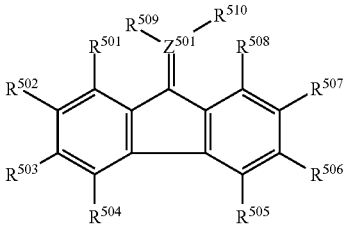

(A6)

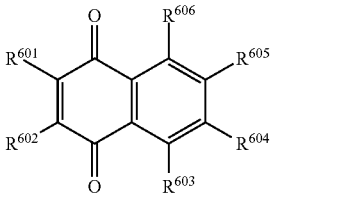

(A7)

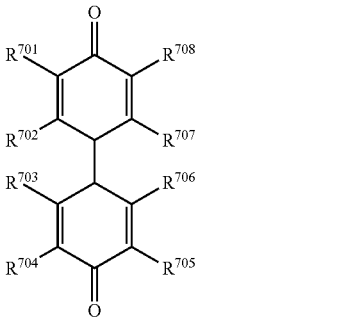

-continued (A8)

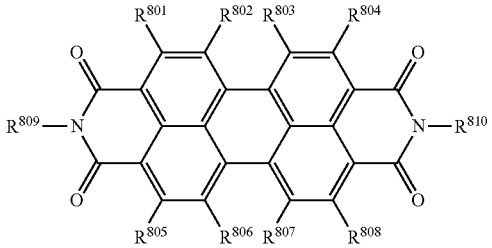

in the formulae (A1) to (A8):

$R^{101}$ to $R^{106}$, $R^{201}$ to $R^{210}$, $R^{301}$ to $R^{308}$, $R^{401}$ to $R^{408}$, $R^{501}$ to $R^{510}$, $R^{601}$ to $R^{606}$, $R^{701}$ to $R^{708}$, and $R^{801}$ to $R^{810}$ each independently represent a monovalent group represented by the following formula (A), a hydrogen atom, a cyano group, a nitro group, a halogen atom, an alkoxycarbonyl group, an unsubstituted or substituted alkyl group, a group derived by substituting one of carbon atoms in a main chain of the unsubstituted or substituted alkyl group with an oxygen atom, a group derived by substituting one of the carbon atoms in the main chain of the unsubstituted or substituted alkyl group with a sulfur atom, a group derived by substituting one of the carbon atoms in the main chain of the unsubstituted or substituted alkyl group with $NR^{10}$, or an unsubstituted or substituted aryl group, and $R^{10}$ represents a hydrogen atom or an alkyl group, provided that at least one of $R^{101}$ to $R^{106}$, at least one of $R^{201}$ to $R^{210}$, at least one of $R^{301}$ to $R^{308}$, at least one of $R^{401}$ to $R^{408}$, at least one of $R^{501}$ to $R^{510}$, at least one of $R^{601}$ to $R^{606}$, at least one of $R^{701}$ to $R^{708}$, and at least one of $R^{801}$ to $R^{810}$ each represent the monovalent group represented by the formula (A);

a substituent of the substituted alkyl group is an alkyl group, an aryl group, or a halogen atom, and a substituent of the substituted aryl group comprises a halogen atom, a nitro group, a cyano group, an alkyl group, or a halogenated alkyl group;

$Z^{201}$, $Z^{301}$, $Z^{401}$, and $Z^{501}$ each independently represent a carbon atom, a nitrogen atom, or an oxygen atom;

$R^{209}$ and $R^{210}$ are absent when $Z^{201}$ represents the oxygen atom, and $R^{210}$ is absent when $Z^{201}$ represents the nitrogen atom;

$R^{307}$ and $R^{308}$ are absent when $Z^{301}$ represents the oxygen atom, and $R^{308}$ is absent when $Z^{301}$ represents the nitrogen atom;

$R^{407}$ and $R^{408}$ are absent when $Z^{401}$ represents the oxygen atom, and $R^{408}$ is absent when $Z^{401}$ represents the nitrogen atom; and $R^{509}$ and $R^{510}$ are absent when $Z^{501}$ represents the oxygen atom, and $R^{510}$ is absent when $Z^{501}$ represents the nitrogen atom:

(A)

$$-(\alpha)_l-(\beta)_m-\gamma$$

in the formula (A):

at least one of α, β, and γ represents a group having a polymerizable functional group, and the polymerizable functional group comprises at least one kind of group selected from the group consisting of a hydroxy group, a thiol group, an amino group, and a carboxyl group;

l and m each independently represent 0 or 1, and a sum of l and m is 0 or more and 2 or less;

α represents an unsubstituted or substituted alkylene group having 1 to 6 main-chain carbon atoms, a group derived by substituting one of the carbon atoms in a main chain of the unsubstituted or substituted alkylene group having 1 to 6 main-chain carbon atoms with an oxygen atom, a group derived by substituting one of the carbon atoms in the main chain of the unsubstituted or substituted alkylene group having 1 to 6 main-chain carbon atoms with a sulfur atom, or a group derived by substituting one of the carbon atoms in the main chain of the unsubstituted or substituted alkylene group having 1 to 6 main-chain carbon atoms with $NR^{19}$, and each of the groups represented by a may have the polymerizable functional group;

$R^{19}$ represents a hydrogen atom or an alkyl group;

a substituent of the substituted alkylene group is an alkyl group having 1 to 6 carbon atoms, a benzyl group, an alkoxycarbonyl group, or a phenyl group;

represents a phenylene group, a phenylene group substituted with an alkyl group having 1 to 6 carbon atoms, a phenylene group substituted with a nitro group, a phenylene group substituted with a halogen atom, or a phenylene group substituted with an alkoxy group, and each of the groups represented by β may have the polymerizable functional group; and γ represents a hydrogen atom, an alkyl group having 1 to 6 main-chain carbon atoms, or an alkyl group having 1 to 6 main-chain carbon atoms and substituted with an alkyl group having 1 to 6 carbon atoms, and each of the groups represented by γ may have the polymerizable functional group.

9. A method of producing an electrophotographic photosensitive member according to claim 8, wherein the undercoat layer satisfies the following expression (8):

$$0.4 \leq (iii)/(i)+(ii) \leq 1.0 \quad (8)$$

in the expression (8), (i), (ii), and (iii) represent contents of the compounds (i), (ii), and (iii) with respect to a total mass of the composition, respectively.

10. A method of producing an electrophotographic photosensitive member according to claim 8, wherein $R^1$ and $R^2$ in the formula (1) each independently represent a single bond, a methylene group, an ethylene group, or a propylene group.

* * * * *